US010538847B2

(12) United States Patent
Gordon

(10) Patent No.: US 10,538,847 B2
(45) Date of Patent: Jan. 21, 2020

(54) METHOD AND APPARATUS FOR RECOVERING METALS AND SULFUR FROM FEED STREAMS CONTAINING METAL SULFIDES AND POLYSULFIDES

(71) Applicant: Enlighten Innovations Inc., Calgary (CA)

(72) Inventor: John Howard Gordon, Salt Lake City, UT (US)

(73) Assignee: ENLIGHTEN INNOVATIONS INC., Calgary (CA)

( * ) Notice: Subject to any disclaimer, the term of this patent is extended or adjusted under 35 U.S.C. 154(b) by 114 days.

(21) Appl. No.: 15/393,717

(22) Filed: Dec. 29, 2016

(65) Prior Publication Data

US 2018/0187317 A1 Jul. 5, 2018
US 2018/0363153 A9 Dec. 20, 2018

Related U.S. Application Data

(60) Provisional application No. 62/272,224, filed on Dec. 29, 2015.

(51) Int. Cl.
*C25B 9/18* (2006.01)
*C25C 7/00* (2006.01)
(Continued)

(52) U.S. Cl.
CPC ..... *C25B 9/18* (2013.01); *C25B 1/00* (2013.01); *C25B 13/08* (2013.01); *C25C 1/02* (2013.01);
(Continued)

(58) Field of Classification Search
None
See application file for complete search history.

(56) References Cited

U.S. PATENT DOCUMENTS 4,105,534 A * 8/1978 Beatty, III ..... B01D 61/46 204/238
4,472,255 A * 9/1984 Millington ..... C25B 9/206 204/255

(Continued)

FOREIGN PATENT DOCUMENTS

EP 0 589 501 A2 3/1994
WO WO-93/25636 A1 12/1993

OTHER PUBLICATIONS

Leitz et al, Enhanced mass transfer in electrochemical cells using turbulence promoters, Journal of Applied Electrochemistry, Nov. 1977, vol. 7, No. 6, pp. 473-484 (Year: 1977).*

(Continued)

*Primary Examiner* — Harry D Wilkins, III
(74) *Attorney, Agent, or Firm* — Foley & Lardner LLP

(57) ABSTRACT

A system to remove sodium and Sulfur from a feed stream containing alkali metal sulfides and polysulfides in addition to heavy metals. The system includes an electrolytic cell having an anolyte compartment housing an anode in contact with an anolyte. The anolyte includes alkali metal sulfides and polysulfides dissolved in a polar organic solvent. The anolyte includes heavy metal ions. A separator includes an ion conducting membrane and separates the anolyte compartment from a catholyte compartment that includes a cathode in contact with a catholyte. The catholyte includes an alkali ion-conductive liquid. A power source applies a voltage to the electrolytic cell high enough to reduce the alkali metal and oxidize Sulfur ions to allow recovery of the alkali metal and elemental sulfur. The ratio of sodium to Sulfur is such that the open circuit potential of the electrolytic cell is greater than about 2.3V.

46 Claims, 6 Drawing Sheets

(51) Int. Cl.

| | |
|---|---|
| ***C25C 1/02*** | (2006.01) |
| ***C25C 7/08*** | (2006.01) |
| ***C25C 7/02*** | (2006.01) |
| ***C25C 7/04*** | (2006.01) |
| ***C25B 13/08*** | (2006.01) |
| ***C25B 1/00*** | (2006.01) |
| *C10G 27/00* | (2006.01) |

(52) U.S. Cl.
CPC ..... *C25C 7/00* (2013.01); *C25C 7/02* (2013.01); *C25C 7/04* (2013.01); *C25C 7/08* (2013.01); *C10G 27/00* (2013.01)

(56) References Cited

U.S. PATENT DOCUMENTS

| | | | |
|---|---|---|---|
| 4,561,945 | A | 12/1985 | Coker et al. |
| 2009/0134040 | A1 | 5/2009 | Gordon et al. |
| 2011/0100874 | A1 | 5/2011 | Gordon |
| 2014/0197040 | A1 | 7/2014 | Gordon et al. |

OTHER PUBLICATIONS

International Preliminary Report on Patentability in International Application No. PCT/US2016/069162 dated Jul. 3, 2018 (10 pages).
International Search Report and Written Opinion in International Application No. PCT/US2016/069162 dated Apr. 18, 2017 (11 pages).
Extended European Search Report in EP16882652.7 dated Jul. 24, 2019 (6 pages).
Search Report and Written Opinion in SG Application No. 11201805574Q dated Oct. 10, 2019 (9 pages).

* cited by examiner

METHOD AND APPARATUS FOR RECOVERING METALS AND SULFUR FROM FEED STREAMS CONTAINING METAL SULFIDES AND POLYSULFIDES

CROSS-REFERENCE TO RELATED APPLICATIONS

This application claims priority to U.S. Provisional Application No. 62/272,224 filed Dec. 29, 2015 and is expressly incorporated herein by reference.

FIELD OF THE INVENTION

The present invention relates to the recovery of metal and Sulfur from a feed stream containing alkali metal sulfides and polysulfides. More particularly, the invention relates to a method and apparatus for separating and recovering alkali metal compounds, reduced heavy metals, and Sulfur from feed streams containing alkali metal sulfides and polysulfides and certain heavy metals using a single electrochemical system.

BACKGROUND OF THE INVENTION

The demand for energy and the hydrocarbons from which that energy is derived is continually rising. The hydrocarbon raw materials used to provide this energy, however, contain difficult to remove Sulfur and metals that hinder the processing of these materials and thus limit their usage as an energy source. Additionally, Sulfur can cause air pollution when hydrocarbon sources such as gas or oil are consumed. Sulfur can poison catalysts designed to remove hydrocarbons and nitrogen oxide from motor vehicle exhaust. Thus hydrocarbon sources such as crude oil, bitumen, heavy oil, oil products, or portions thereof such as residues, vacuum residues, and distillates are treated to remove unwanted items such as Sulfur or nitrogen.

Over the last several years, sodium has been recognized as being effective for the removal or reduction of Sulfur from hydrocarbon sources that would otherwise be unusable due to the high Sulfur content. Sodium is capable of reacting with Sulfur and other constituents in the hydrocarbon source, including any contaminants that may be found in the hydrocarbon source, to dramatically reduce the Sulfur and other unwanted items such as nitrogen. The Sulfur reduction is accomplished through the formation of sodium sulfide compounds such as sodium metal sulfide, polysulfide and hydrosulfide. Other alkali metals such as Lithium have also shown to be effective in the same way.

However, other metals, including heavy metals, contained in the hydrocarbon source can inhibit or prevent the process of removing unwanted materials such as sulfur or nitrogen from the hydrocarbon source. For example, heavy metals can poison catalysts typically utilized for removal of Sulfur through standard and improved hydro-desulfurization processes whereby hydrogen reacts under extreme conditions to break down the Sulfur bearing organo-sulfur molecules. At a minimum, this can make the desulfurization or denitrotization of the hydrocarbon source prohibitively expensive. Thus it is also desirous to remove heavy metals contained in the hydrocarbon source.

Heavy metal may be removed from hydrocarbon sources using alkali metals such as sodium or lithium. Heavy metals contained in organometallic molecules such as complex porphyrins are reduced to the metallic state by the alkali metal. Once the heavy metals have been reduced, they can be separated from the hydrocarbon source because they no longer are chemically bonded to the organic structure. In addition, once the metals are removed from the porphyrin structure, the nitrogen heteroatoms in the structure can be exposed for further denitrogenation.

The resulting byproduct of the treatment of hydrocarbon sources using alkali metal to remove Sulfur or other unwanted materials such as heavy metal can be a feed stream that contains alkali metal sulfides and polysulfides and amounts of heavy metal. The treatment of hydrocarbons using alkali metal is expensive because of the cost of the raw materials needed. However, if the alkali metal could be recovered and reused, it would limit the costs. Further, if Sulfur could be recovered from this byproduct feed stream, it would further reduce the treatment costs and could possibly become a source of revenue.

One problem, however, in the recovery of alkali metal and Sulfur from solution created as a result of desulfurization or demetalization processes, is that this solution feed stream also contains non alkali metals, such as heavy metals, that hinder, inhibit, or prevent the alkali metal and Sulfur recovery process.

Thus it would be an advantage to provide a method and apparatus to facilitate separation and recovery of the alkali metal and Sulfur from feed streams, regardless of the presence of heavy metals in the feed stream. It would be another advantage to provide such a recovery of the alkali metal and Sulfur efficiently using in a single process and system.

BRIEF SUMMARY OF THE INVENTION

The invention has been developed in response to the present state of the art and, in particular, in response to the problems and needs in the art that have not yet been fully solved by currently available alkali metal and Sulfur recovery technologies. Accordingly, the invention has been developed to provide systems and methods to remove alkali metal and Sulfur from non-aqueous feed streams containing alkali metal sulfides and/or polysulfides, and small amounts of heavy metal. The features and advantages of the invention will become more fully apparent from the following description and appended claims, or may be learned by practice of the invention as set forth hereinafter.

Consistent with the foregoing and in accordance with the invention as embodied and broadly described herein, a system for recovering metal and Sulfur from a non-aqueous feed stream that also contains heavy metal is described herein. The term "heavy metal" as used herein throughout means Copper, Bismuth, Aluminum, Titanium, Vanadium, Manganese, Chromium, Zinc, Tantalum, Germanium, Lead, Cadmium, Indium, Thallium, Cobalt, Nickel, Iron, and Gallium. The term "heavy metal" may also include all metals with a standard reduction potential of 2.7V and below under standard conditions. It will be appreciated by those of skill in the art that the standard conditions used include: 25° C., a 1 activity for each ion participating in the reaction, a partial pressure of 1 bar for each gas that is part of the reaction, and metals in their pure state.

In one embodiment, an electrolytic cell is utilized having an anolyte compartment configured to hold an anolyte. The anolyte compartment may have a first inlet and a first outlet. The anolyte comprises the non-aqueous feed stream and includes at least one of an alkali metal sulfide and an alkali metal polysulfide. The anolyte also includes a polar organic solvent that dissolves at least one of the alkali metal sulfide, alkali metal polysulfide. The solvent also dissolves elemental sulfur. The feed stream in the anolyte may also contain at least one of a heavy metal, a heavy metal compound, and a heavy metal ion. An anode is positioned within the anolyte compartment in communication with the anolyte.

The electrolytic cell also includes a catholyte compartment configured to hold a catholyte which comprises an alkali ion-conductive liquid. The catholyte compartment may also include an inlet and an outlet. A cathode is positioned within the catholyte compartment and is in communication with the catholyte. A separator may be positioned between the anolyte compartment and the catholyte compartment such that it is communication with both the anolyte and the catholyte. The separator may be configured to non-selectively transport cations.

A power source is in electrical communication with the anode and the cathode. The power source applies a voltage to the electrolytic cell that is above the decomposition voltage of an alkali metal sulfide or an alkali metal polysulfide in the anolyte compartment. Thus the voltage is sufficient for alkali metal cations to reduce to alkali metal. The voltage is also high enough to oxidize at least one Sulfur ion in the anolyte compartment into elemental sulfur. The alkali metal may be removed from the catholyte compartment and the elemental Sulfur may be removed from the anolyte compartment.

In one embodiment, elemental Sulfur is applied to the anolyte compartment. The Sulfur helps dissolve alkali metal sulfides and polysulfides to a higher concentration. Heat may also be applied to the anolyte and/or catholyte compartments, and/or to the system generally. In one embodiment, the system is operated at a temperature of between about 100° C. and about 160° C. At these temperatures, the solubilities of both Sulfur and solids such as iron sulfide, nickel sulfide, and vanadium sulfide are high. Upon the application of the voltage, alkali metal cations and heavy metal cations, attracted to the cathode, flow through the separator into the catholyte compartment. Sulfur, having a neutral charge, and sulfide and polysulfide anions, which have negative charge, tend to stay in the anolyte compartment. With predetermined applied voltage being high enough, heavy metal cations such as iron metal cations, nickel metal cations, vanadium metal cations, and the like reduce at the cathode and plate out there. Depending upon the applied voltage, the sodium cations may stay as dissolved sodium cations in the catholyte solution. If the voltage is high enough, the sodium cations will be reduced to metallic state and will be liquid in this temperature range. The plated metals can easily be recovered by ways know in the art such as removing the cathode and scraping off the heavy metal. The sodium metal, if formed, will become a second liquid phase which can be siphoned off and recovered, or allowed to cool to the solid phase outside the cell and separated from the catholyte.

Sulfide ions in the anolyte compartment may oxidize to higher polysulfides or to elemental sulfur. A portion of the anolyte containing the elemental Sulfur may be removed and place in a separation tank. The elemental Sulfur may be recovered by ways know in the art, such as cooling the anolyte to decrease the solubility of the elemental sulfur, sink it, and recovering it from the bottom of the anolyte. The anolyte by also be cooled such that it forms crystals that settle on the bottom of the anolyte compartment and can then be recovered. Alternatively the elemental Sulfur may be separated from the anolyte through other means such as filtration or centrifugation.

In other embodiments, more than one electrolytic cell may be used. One cell may combine a predetermined voltage and separator such that the heavy metal cations in the anolyte pass through the separator and plate at the cathode, while the voltage is kept below the decomposition voltage of the alkali cations. In this way, the metal can be removed in a first step and the resulting anolyte may be passed to the second electrolytic cell. This cell may have cation-specific membrane where only the alkali metal cations may pass from the anolyte into the catholyte and reduced at the cathode with minimal interference from the already removed heavy metals. The voltage in the second cell can be high enough to oxidize the sulfide ions, which were prevented from passing through the cation-specific membrane, into elemental Sulfur which can then be recovered.

The present invention provides a system and method for recovery alkali metal and elemental Sulfur from a feed stream, in spite of the presence of heavy metals in the feed stream. The features and advantages of the present invention will become more fully apparent from the following description and appended claims, or may be learned by practice of the invention as set forth hereinafter.

BRIEF DESCRIPTION OF THE DRAWINGS

In order that the advantages of the invention will be readily understood, a more particular description of the invention briefly described above will be rendered by reference to specific embodiments illustrated in the appended drawings. Understanding that these drawings depict only typical embodiments of the invention and are not therefore to be considered limiting of its scope, the invention will be described and explained with additional specificity and detail through use of the accompanying drawings in which.

DETAILED DESCRIPTION OF THE INVENTION

Figure 1:
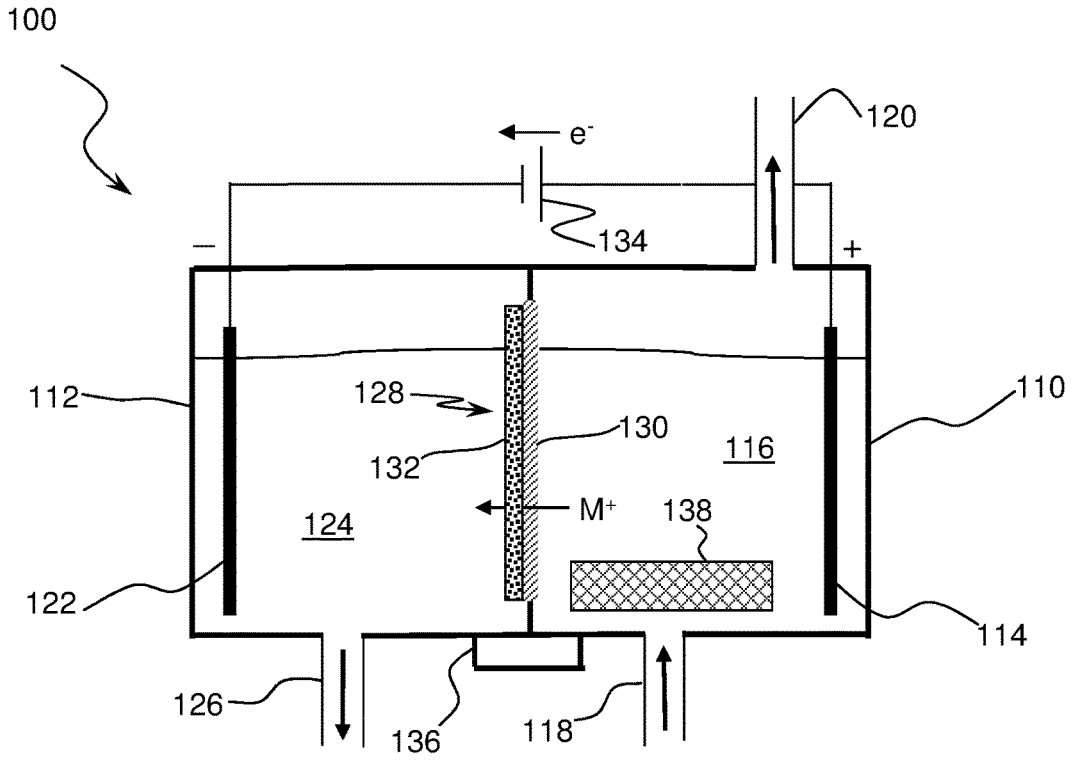
FIG. 1 is a high-level block diagram showing one embodiment of a sodium-sulfur removal system with one electrolytic cell.

In the following description, specific details of various embodiments are provided. The present invention may be embodied in other specific forms without departing from its spirit or essential characteristics. The described embodiments are to be considered in all respects only as illustrative and not restrictive. While the various aspects of the embodiments are presented in drawings, the drawings are not necessarily drawn to scale unless specifically indicated. The scope of the invention is, therefore, indicated by the appended claims rather than by the foregoing description. All changes which come within the meaning and range of equivalency of the claims are to be embraced within their scope.

Reference throughout this specification to features, advantages, or embodiments does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment. The presently described embodiments will be better understood by reference to the drawings, wherein like parts are designated by like numerals throughout.

The present embodiments relate to a method and system of separating and removing alkali metal and elemental Sulfur from a feed stream that contains alkali metal sulfides and polysulfides, and that may also contain heavy metal in some form. Embodiments of the present invention may include a single electrolytic cell or multiple electrolytic cells in combination. In certain embodiments, one or more of three distinct electrolytic cells are used in a variety of combinations.

By way of non-limiting clarification only, in the discussion below and herein throughout, the discussion of the first of three such electrolytic cells will be referred to as a "first" electrolytic cell to help distinguish it from the other two different but similar electrolytic cells. Components of the "first" electrolytic cell will include the designation, "first" to help distinguish the components of the first electrolytic cell from the components of other electrolytic cell used in a particular combination. Similarly, a "second" designation may be used with a second electrolytic cell and its various components when two cells are used in combination to help identify and distinguish between similar components used in both cells. Additionally, because embodiments of three electrolytic cells will be described, the third electrolytic cell and its various components may be referred to with a "third" designation. Accordingly, the designation "first" used with a particular electrolytic cell should not be interpreted to mean that there is more than one electrolytic cell in a particular embodiment of the system. Indeed the system of the present invention may in some embodiments include only one electrolytic cell. The "first" designation, when used with a particular component of an electrolytic cell, should not be interpreted to mean that there must necessarily be more than one of any such component in the first electrolytic cell, although there may be. Similarly, use of the designation "second" in any of the descriptions of embodiment herein should not be interpreted to mean that there must be two electrolytic cells in the embodiment, although there may, or two of any such components within a single electrolytic cell, although there may be. The designation "third" used with a particular electrolytic cell should not be interpreted by the reader to mean that the must necessarily be a particular number of electrolytic cells or a particular number of components for any one electrolytic cell. The designations are simply labels to help the read identify which components may be associated with which particular electrolytic cell. In some instances the designation "first", "second" or "third" may not be used, but the various components of the various electrolytic cells may be discernable from the context of the discussion.

Referring now to FIG. 1, a system for recovering metal and elemental Sulfur from a non-aqueous feed stream is shown. In one embodiment, the system is a first electrolytic cell 100. The first electrolytic cell 100 includes a first anolyte compartment 110 and a first catholyte compartment 112. A first anode 114 is positioned with the first anolyte compartment 110. In one embodiment, the first anode 114 may be fabricated from an electrically conductive material such as stainless steel, nickel, iron, iron alloys, nickel alloys, graphite and other anode materials known in the art. The first anode 114 may be coated with an electroactive material such as platinum coated titanium, or electroactive oxides such as ruthenium oxide, iridium oxide, tantalum oxide and the like and combinations thereof and other oxides known in the art. The first anode 114 may be an electronically conductive material know to not oxidize when positively charged under a potential gradient in an electrolyte. The first anode 114 may be a mesh, monolithic structure or may be a monolith with features to allow passage of anolyte through the anode structure. The first anolyte compartment 110 holds an anolyte 116 that is in communication with the first anode 114 to allow chemical or electrochemical interaction between the first anode 114 and the anolyte 116. The first anolyte compartment 110 may include one or more inlets 118 and outlets 120. In one embodiment, the first anode 114 is removably positioned within the first anolyte compartment 110. This configuration may facilitate harvesting elemental Sulfur from the first anolyte compartment 110, as will be discussed in further detail below. Accordingly, the first anolyte compartment 110, and/or the first electrolytic cell 100 is configured to allow such removal of the first anode 114. In one embodiment, one or both of the first anolyte and first catholyte compartments (110, 112) may include a vent (not shown) for venting any gas that may be generated in the compartments (110, 112) using the apparatus or method described herein. This may be desirous, for example, if alkali metal hydrosulfide is in the anolyte, and the electrochemical process releases hydrogen sulfide that does not stay dissolved in the anolyte 116 or catholyte 122.

The anolyte 116 comprises at least one of an alkali metal sulfide and an alkali metal polysulfide. In one embodiment, the alkali metal sulfide may include sodium sulfide. The alkali metal sulfide may also include lithium sulfide. Similarly, in one embodiment, the alkali metal polysulfide may include sodium polysulfide. The alkali metal polysulfide may also include lithium polysulfide. In one embodiment, anolyte 116 is a feed stream that is the resulting non-aqueous stream from a desulfurization process where sodium is reacted with Sulfur in a hydrocarbon source. Accordingly, the resulting stream that is fed into the first anolyte compartment 110 of the first electrolytic cell 100 will have alkali metal sulfides and polysulfides. The resulting stream will also have at least one heavy metal, which may be in various forms, including metal compounds or a dissolved or disassociated metal ion. References to "metal" herein includes metal as it may appear in any form. Non-limiting examples of the alkali metal may include sodium and lithium. Non-limiting examples of heavy metals may include vanadium, nickel, iron, copper, lead, silicon and those referenced above.

In one embodiment, the anolyte 116 includes a polar organic solvent. The polar organic solvent dissolves at least one of the alkali metal sulfide and the alkali metal polysulfide. The polar organic solvent also dissolves elemental sulfur. The term "dissolve", in any of its forms, including without limitation, "dissolves," "dissolved," and "dissolving" is meant to include partial dissolving. The polar organic solvent may include one or more of N,N-dimethylaniline, quinoline, tetrahydrofuran, 2-methyl tetrahydrofuran, benzene, cyclohexane, fluorobenzene, trifluorobenzene, toluene, xylene, tetraglyme, diglyme, isopropanol, ethyl propional, dimethyl carbonate, dimethoxy ether, ethanol and ethyl acetate, propylene carbonate, ethylene carbonate, diethyl carbonate, 1,3-Dimethyl-3,4,5,6-tetrahydro-2-pyrimidinone. Methylformide, and 1,3-Dimethyl-2-imidazolidinone (DMI) and the like.

In one embodiment, the alkali metal sulfide and the alkali metal polysulfide dissolves in the anolyte 116 and creates a higher concentration of ions of the alkali metal sulfide and polysulfide. When the ion concentration is higher, the first electrolytic cell 100 performs more efficiently. In one embodiment, the anolyte comprises elemental sulfur. The addition of elemental Sulfur dissolved in the solvent increases the solubility of the alkali metal sulfide and polysulfide to further facilitate the dissolving of the alkali metal sulfide and polysulfide in the anolyte 116. It will be appreciated by those of skill in the art that the additional alkali metal cations introduced by the dissolved alkali metal sulfide and polysulfide also helps cell performance by increasing mass transport conditions of the cations.

A first cathode 122 is positioned within the first catholyte compartment 112. In one embodiment, the first cathode 122 may be made of graphite, iron, steel, stainless steel, or other electronically conductive materials. The first catholyte compartment 112 holds a catholyte 124 that is in communication with the first cathode 122 to allow chemical or electrochemical interaction between the first cathode 122 and the catholyte 124. The first catholyte compartment includes an inlet (not shown) and an outlet 126. In one embodiment, the first cathode 122 is removably positioned within the first catholyte compartment 112 to facilitate harvesting metal that plates thereon, as will be discussed in further detail below. Accordingly, the first catholyte compartment 112, and/or the first electrolytic cell 100 is configured to allow such removal of the first cathode 122.

The catholyte 124 comprises an alkali ion-conductive liquid. In one embodiment, the ion-conductive liquid comprises a catholyte solvent containing alkali metal ions. Where the catholyte 124 includes molten alkali metal, the alkali metal should be the alkali metal that is in the alkali metal sulfide or polysulfide in the anolyte. In one embodiment, the ion-conductive liquid includes both a catholyte solvent containing alkali metal ions and droplets of molten alkali metal which may form at the first cathode 122. The catholyte solvent may include one or more of tetraglyme, diglyme, dimethyl carbonate, dimethoxy ether, propylene carbonate, ethylene carbonate, diethyl carbonate and the like. In one embodiment, the catholyte includes an alkali metal salt such as an iodide or chloride, perchlorate, or a fluoroborate of the alkali metal. The catholyte solvent and the bath of molten alkali metal facilitate ion conductivity in the catholyte 124 which allows the necessary redox reactions to occur in the cell 100.

It will be appreciated by those of skill in the art that there are a variety of cell configurations that would allow access the first anolyte and first catholyte compartments (110, 112). For example, in one embodiment, it may be advantageous to have multiple inlets to the first anolyte or first catholyte compartments (110, 112) for a variety of reasons, including to confine the interaction or reaction of the respective constituents of the anolyte 116 or catholyte 124 to their respective compartments (110, 112), instead of allowing them to mix outside the compartment. Similarly, it may be desirous to have multiple outlets. Additionally, where appropriate, the functions of an inlet and an outlet may be combined, such that one opening is both an inlet and an outlet. See 126 in FIG. 1, for example. Thus, it is within the scope of this invention that the first anolyte compartment 110 and the first catholyte compartment 112 have multiple inlets and outlets. It is also within the scope of this invention that the inlet and outlet of the first anolyte compartment 110 is the same opening and the inlet and outlet of the first catholyte compartment 112 is the same opening.

In one embodiment, a first separator 128 is positioned between the first anolyte compartment 110 and the first catholyte compartment 112. The first separator 128 is in communication with the anolyte 116 and the catholyte 124, such that under certain electrochemical conditions discussed below, ions can pass from the first anolyte compartment 110 into the first catholyte compartment 112. The first separator 128 is configured to non-selectively transport cations, including metal cations $M^{+}$ such as alkali metal cations or other heavy metal cations which may be in the anolyte. As used herein, "$M^{+}$" indicates a metal cation, and includes cations of a various types of metal, and metals or other ions with a positive charge of one or more. Thus, as used herein, the designation "$M^{+}$" is inclusive of metal cations with higher oxidation states, such as could otherwise be designated $M^{'++}$ or $M^{''+++}$. In one embodiment, the alkali metal cations are sodium or lithium cations.

The first separator 128, may be at least one of a cation exchange membrane and a microporous membrane 130. In other embodiments, the first separator 128 may be porous and have a porosity larger than microporosity. In one embodiment, the first separator 128 may be permeable to cations and substantially impermeable to anions, solvent and dissolved elemental sulfur. The alkali metal in one embodiment is either sodium or lithium. In one embodiment, a cation exchange membrane provides a higher current efficiency. The cation exchange membrane also serves to hinder sulfide ions in the first anolyte compartment 110 from moving through the first separator 128 into the first catholyte compartment 112.

The first separator 128 may be made of a porous polymer film such as polypropylene. In other embodiments, the first separator 128 could be a mat of microfibers or other separator materials known in the art to substantially prevent convection or mixing of the anolyte and catholyte. In one embodiment, the first separator 128 is a microporous organic polymer network. In another embodiment, the first separator 128 is a micro porous polymer film such as polypropylene. An examples of a micro porous polymer film includes film sold under the product name Celgard® 2400. Celgard is a registered trademark of Celgard, LLC. The first separator 128 may also be made of a cation exchange material such as a sulfonated tetrafluoroethylene based fluoropolymer-copolymer. Such material may be sold under the trademark Nation®, a registered trademark of the E. I. Du Pont De Nemours and Company Corporation. The first separator 128 may be a cation exchange membrane that includes fixed negatively charged constituents within its structure and non-fixed cations which are exchangeable and mobile. Such a cation exchange membrane material may include those manufactured by Neosepta. The cation exchange membrane serves to restrict migration of negatively charged anions from the anolyte to the catholyte.

The first separator 128 may comprise a combination of cation exchange membranes, porous materials and microporous or even nano porous materials. In one embodiment, the first separator 128 comprises material configured to non-selectively transport cations 130 attached to a porous substrate 132 or other material that non-selectively transports cations. For example, in one embodiment a cation exchange membrane may be in the form of a film applied to a substrate or other first separator 128 materials. It will be appreciated by those of skill in the art that these materials 130 may be attached to the porous substrate 132 or other separator materials 130 in any number of known ways, including without limitations, laminating, spray coating, vapor deposition coating, attaching or painting the material to the porous substrate in the green state and cofiring the pair, and the like. The porous substrate 132 may be positioned between the material 130 and the first cathode 122. In this configuration, the porous substrate is a buffer or spacer between the catholyte/cathode and the material, which for example may be a cation exchange membrane.

As will be discussed in more detail below, when a voltage is applied to the cell, metal cations $M^+$ that pass through the first separator 128, will reduce in the catholyte. Some may reduce immediately upon receiving electrons from the cathode or any metal already plated onto the cathode, including protruding dendrites. The addition of the porous substrate 132 serves as a buffer or spacer between a cation exchange membrane 130, for example, and the first catholyte compartment 112 increases the probability that the reduction will occur at the porous substrate and not immediately on the cation exchange membrane. When metals reduce on the cation exchange membrane, cell 100 performance ultimately may decrease. The porous substrate slows this process. Additionally, where the first cathode 122 is positioned close to the cation exchange membrane 130, dendrite formation may occur at the first cathode 122 which could expand into the cation exchange membrane 130 negatively affecting cell 100 performance. The porous substrate 132 protects the cation exchange membrane 130 against dendrite formation at the first cathode 122.

The first electrolytic cell 100 also includes a first power source 134 in electrical communication with the first anode 114 and the first cathode 122. The first power source 134 is configured to apply a voltage to the first electrolytic cell 100 cell that is sufficient to reduce at least one heavy metal ion to heavy metal. In one embodiment, the voltage applied to the first electrolytic cell 100 by the first power source 134 is sufficient to reduce at least one alkali metal ion in the first electrolytic cell to alkali metal. In one embodiment, the first power source 134 is configured to apply a voltage to the first electrolytic cell 100 sufficient to increase the oxidation state of at least one sulfide ion in the first electrolytic cell 100. In one embodiment, this may mean increasing a monosulfide ion into a polysulfide ion. It may also mean creating a higher polysulfide. For example, the voltage may drive the monosulfide $S^{2-}$ to the polysulfide $S_2^{2-}$, or the polysulfide $S_4^{2-}$ to a higher polysulfide such as $S_6^{2-}$ or $S_8^{2-}$. In one embodiment, the voltage may drive higher polysulfides to elemental sulfur.

In one embodiment, the first power source 134 is configured to apply a voltage to the first electrolytic cell 100 that is greater than an open circuit potential of the first electrolytic cell 100. It will be appreciated by those of skill in the art that under certain conditions, relative to the concentration of constituents in the first electrolytic cell 100, the alkali metal ions will reduce to alkali metal when they pick up an electron. In one embodiment, this will occur in the first catholyte compartment 112.

In one embodiment, where the alkali metal of the alkali metal sulfide or polysulfide is sodium, the ratio of sodium to Sulfur in the first anolyte compartment 110 is, or may be maintained, such that the open circuit potential of the first electrolytic cell 100 is greater than 2.3V. It will be appreciated by those of skill in the art that under these conditions, sodium metal ions that pass from the first anolyte compartment 110 to the first catholyte compartment 112 through the separator 128, will reduce to sodium metal in the catholyte compartment 112. It will be appreciated by those of skill in the art that under these conditions with this voltage, sulfide ions in the first anolyte compartment 110 may oxidize and form elemental sulfur.

In one embodiment, where the alkali metal of the alkali metal sulfide or polysulfide is lithium, the ratio of lithium to Sulfur in the first anolyte compartment 110 is, or may be maintained, such that the open circuit potential of the first electrolytic cell 100 is greater than 2.63V. It will be appreciated by those of skill in the art that under these conditions, lithium metal ions that pass from the first anolyte compartment 110 to the first catholyte compartment 112 through the separator 128, will reduce to lithium metal in the catholyte compartment 112. It will further be appreciated by those of skill in the art that under these conditions with this voltage, sulfide ions in the first anolyte compartment 110 may oxidize and form elemental sulfur.

It will be appreciated by those of skill in the art that formation of elemental Sulfur, heavy metal, and alkali metal is affected by various factors including the particular ion concentration levels in the first electrolytic cell 100. Accordingly, the first electrolytic cell 100 of the present invention may be configured with sensors, controllers, monitors, regulators, flow meters, access ports and alert mechanisms (not shown) in the first anolyte compartment 110 and the first catholyte compartment 112, and other features that allow the concentration and ratio of constituents such as alkali metal, elemental Sulfur, heavy metal, solvents, open cell voltages, ion oxidation states, and the like, to be monitored, measured, and maintained. The first electrolytic cell 100 of the present invention may also be configured with monitors and controllers to monitor, measure and maintain, predetermined voltages applied to the first electrolytic cell 100 by the first power source 134.

In one embodiment, the first power source 134 is adjustable. The first power source 134 may be automatically adjustable according to input received from sensors, controllers, regulators, flow meters and the like in the first electrolytic cell 100 to maximize the operating efficiency of the cell 100 or maximize the yield of any one of the heavy metal, alkali metal, or elemental Sulfur. In another embodiment, the first electrolytic cell 100 may be configured with alerts to a user when certain conditions exist in the first electrolytic cell 100. This may allow a user to manually adjust the power source 134 outlet. The sensors, controllers, regulators, flow meters (not shown) and means for alerting a user (not shown) of the first electrolytic cell 100 may also be used to automatically or have a user manually adjust other parameters of the first electrolytic cell 100, such as temperature, flow rate, concentrations, pH, and the like.

In one embodiment, the first power source 134 is configured to apply a voltage to the first electrolytic cell 100 that is less than 5V. It will be appreciated by those of skill in the art that under similar conditions, a voltage sufficient to reduce alkali metal ions to alkali metal, is also sufficient to reduce heavy metal ions, as "heavy metal" is defined above, to heavy metal. Thus, as the positive ions of these metals are attracted to the first cathode 122 and pass through the first separator 128, they too will reduce in the first catholyte compartment 112.

In one embodiment, the reduced heavy metals plate onto the first cathode 122 and the alkali metal ions reduce to alkali metal, but remain in the catholyte as droplets when the temperature is above the melting temperature of the alkali metal. In this configuration, the heavy metal can be harvested in any number of ways known in the art, including removing the first cathode 122 from the cell 100 and scraping off the metal. In one embodiment, the first cathode 122 may be a rotating belt that continuously or intermittently rotates out of the catholyte 124 to allow for harvesting and then rotates back into the catholyte 124 for more plating.

This configuration also allows for easier harvesting of the alkali metal. This may be accomplished by methods known in the art, including without limitation, removing the first cathode 122 and scraping, heating, using chemical or electro chemical processes on the first cathode 122, or otherwise separating or cleaning the plated alkali metal off of the first cathode 122. In one embodiment where the alkali metal has reduced, but remained in the catholyte, the alkali metal may be harvested or removed from the system by siphoning off an alkali metal-rich layer that has formed in the first catholyte compartment 112. Depending upon the relative specific gravities of the alkali metal and the surrounding catholyte 124 in the first catholyte compartment 112, the alkali metal may form a layer near the top or the bottom of the first catholyte compartment 112 that may be removed. Depending upon the characteristics of the catholyte, other ways to harvest or separate out the alkali metal may be used. In certain embodiments, for example where the catholyte 124 is a solvent containing alkali ions and the reduced alkali metal is in the form of molten alkali metal droplets, the reduced alkali metal may be removed from the first catholyte compartment 112 by flowing the catholyte 124 with alkali metal droplets and separating them in a vessel outside the first electrolytic cell 100. In other embodiments, the catholyte 124 may be passed through a filter, coalescing the alkali metal droplets for easier removal.

Once sulfide ions are oxidized to elemental sulfur, the elemental Sulfur can also be separated from the anolyte in any number of ways known in the art. In one non-limiting example, a cooling apparatus such as a cooling loop (not shown) may be used. Coolant may enter into the first anolyte compartment 110 through conduits (not shown) positioned within the first anolyte compartment 110. When cooled, the solubility of elemental Sulfur decreases with a greater specific gravity than the surrounding anolyte 116, settles to the bottom of the first anolyte compartment 110 where it may flow from the first anolyte compartment 110 through an outlet (not shown). Alternatively the cooling loop may cool the anolyte below the freezing point of elemental Sulfur and elemental Sulfur crystals may form which settle to the bottom of the first anolyte compartment 110, from which they may be conveyed away through a configuration of conduits, pumps, valves and/or filters (not shown) in combination with one or more outlets 120. Alternatively the elemental Sulfur may be separated from the anolyte 116 through other means such as filtration or centrifugation. In one embodiment, the elemental sulfur may allowed to reach saturation within the first anolyte compartment 110 resulting in the formation of a second liquid phase (not shown) which could be drained or otherwise removed from the first electrolytic cell 100.

In one embodiment, the first electrolytic cell 100 includes a heater 136 in operable communication with at least one of the first anolyte and first catholyte compartments (110, 112). In one embodiment, the heater 136 heats at least one of the first anolyte compartment 110 and catholyte compartment 112 and allows the system to operate at a temperature below melting point of the alkali metal. In this configuration, alkali metal plates onto the cathode 122 along with other metals. The alkali metals and other metals, such as heavy metals, may then be separated from each other after both metals are scraped off or removed from the cathode 122 by heating the mixture and allowing the alkali metal to form a liquid phase that can be separated from other solids.

The heater 136 may increase the solubility of constituents in the solvents of the anolyte and catholyte. For example, heating the anolyte compartment 110 may facilitate the dissolving of the alkali metal sulfide or polysulfide in the presence of elemental sulfur. It will be appreciated by those of skill in the art that the polar solvent may have increased Sulfur solubility at elevated temperatures.

The heater 136 thus improves ion conductivity, which in turn improves cell 100 performance. In one embodiment, the heater 136 allows at least one of the first anolyte compartment 110 and first catholyte compartment 112 to operate at a temperature ranging from 100° C. to 160°. In another embodiment, the temperature may range from 120° C. to 150°. Accordingly, in one embodiment within the scope of the invention, a first electrolytic cell 100 for electrolyzing an alkali metal sulfide or polysulfide is configured where the first electrolytic cell 100 operates at a temperature below the melting temperature of the alkali metal. In another embodiment, a first electrolytic cell 100 for electrolyzing an alkali metal polysulfide may be provided where the first electrolytic cell 100 operates at a temperature above the melting temperature of the alkali metal and where the first cathode 122 in part is immersed in molten alkali metal. In this case the catholyte 124 essentially comprises molten metal but may also include solvent and alkali metal salt. In other embodiments, the heater 136 is a heater for the entire first electrolytic cell 100 generally, instead of a heater for specific compartments of the electrolytic cell 100.

In one embodiment, the first electrolytic cell 100 can be run in batch mode where anolyte 116 is fed into the first anolyte compartment 110 through the inlet 118 and catholyte 124 is fed into the first catholyte compartment 112 through the inlet 126. Elemental Sulfur may be fed into the first anolyte compartment through inlet 118 or through another inlet (not shown). The elemental Sulfur dissolves in the anolyte solvent and elemental Sulfur combined with the solvent facilitates the dissolving alkali metal sulfides and polysulfides in the first anolyte compartment 110 creating cations $M^+$ of alkali metal and d metal along with sulfide ions. Voltage from the power supply 134 is applied to the first anode 114 and first cathode 122 which is sufficient to cause the alkali metal cations and heavy metal cations in the anolyte to migrate through the first separator and plate at the first cathode 122 or settle as metal dissolved in the solvent in the first catholyte compartment. The alkali metal and heavy metal are then harvested or removed.

The first electrolytic cell 100 may also be run in continuous or semi-continuous mode. In this embodiment, the first anolyte compartment 110 may be configured to allow anolyte to flow through the first anolyte compartment 110 in a continuous or semi-continuous manner. Anolyte 116 may continually or intermittently flow between the inlet 118 and the outlet 120 through the first anolyte compartment 110. In this embodiment, an outlet 120 of the first anolyte compartment 110 may be fluidly connected to an inlet 118 of the first anolyte compartment 110. Recycling anolyte through the same cell may increase the velocity of flow. It will be appreciated by those of skill in the art that increased flow velocity may improve mass transfer in the first electrolytic cell 100 by diminishing the boundary layer at the first separator 128 and increasing ion transport.

In one embodiment, the cell may include a turbulence promoter 138. The turbulence promoter 138 may be any of those known in the art to create turbulence. The turbulence promoter 138 may create turbulence by partially obstructing a flow path or redirecting a flow direction. In one embodiment, the first anode 114 serves as the turbulence promotor 138 through features on the first anode 114 surface such as dimples and protrusions. In another embodiment, the first anode 114 may be mesh or a monolithic structure with features to disrupt passage of anolyte through the anode structure. It will be appreciated by those of skill in the art that the turbulence promoter 138 may improve mass transfer in the first electrolytic cell 100 by diminishing the boundary layer of the anolyte and increasing ion transport.

It will be appreciated by those of skill in the art that multiple inlets and outlets may be used in the first anolyte compartment 110 or first catholyte compartment 112 in various configurations to facilitate a variety of fluid flow through the system or ingress or egress into the first anolyte or first catholyte compartments (110, 112). Multiple inlets and outlets in a variety of configurations are within the scope if the invention. Additionally, in some embodiments, pumps, valves, controllers, and/or filters (not shown) of a kind know in the art may be used to facilitate flow of fluids through the system.

Figure 2:
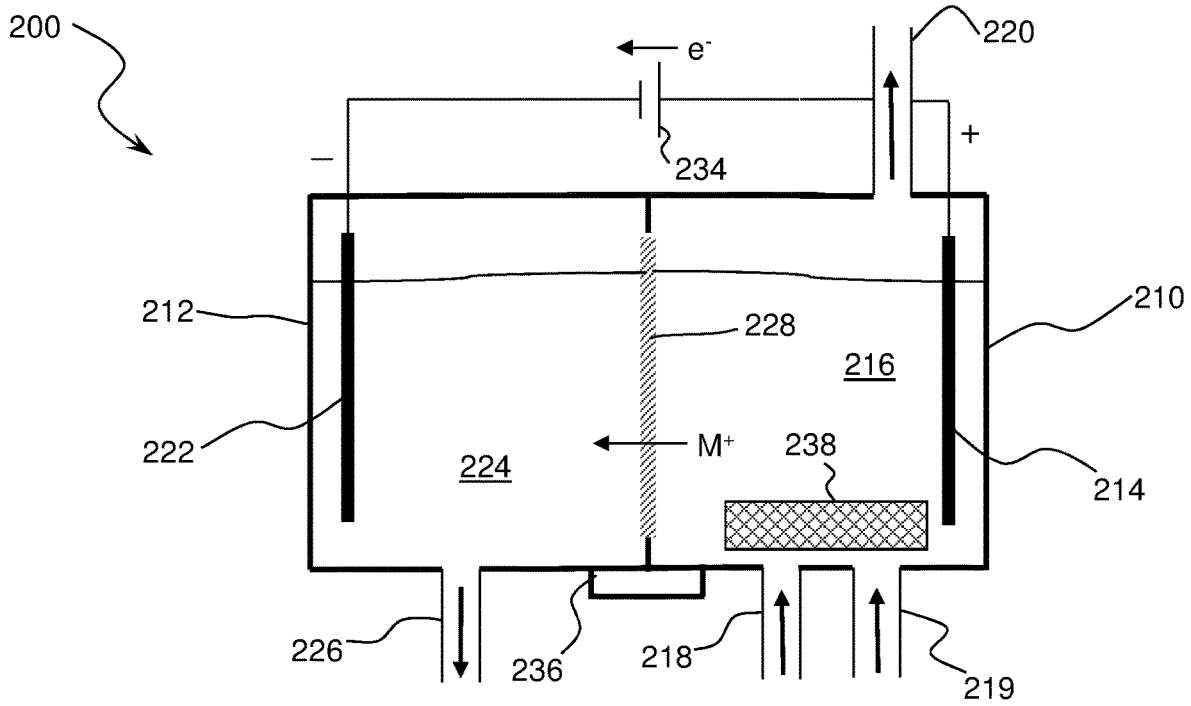
FIG. 2 is a high-level block diagram showing an embodiment of an electrolytic cell used in the sodium-sulfur removal system of the present invention.

Referring now to FIG. 2, a second electrolytic cell 200 is shown. The second electrolytic cell 200 includes a second anolyte compartment 210 and a second catholyte compartment 212. A second anode 214 is positioned within the second anolyte compartment 210. The second anode 214 may be fabricated from an electrically conductive material such as stainless steel, nickel, iron, iron alloys, nickel alloys, graphite and other anode materials known in the art. The second anode 214 may be coated with an electroactive material such as platinum coated titanium, or electroactive oxides such as ruthenium oxide, iridium oxide, tantalum oxide and the like and combinations thereof and other oxides known in the art. In one embodiment, the second anode 214 may be an electronically conductive material know to not oxidize when positively charged under a potential gradient in an electrolyte. The second anode 214 may be a mesh, monolithic structure or may be a monolith with features to allow passage of anolyte through the anode structure.

The second anolyte compartment 210 holds an anolyte 216 that is in communication with the second anode 214 to allow chemical or electrochemical interaction between the second anode 214 and the anolyte 216 within the second anolyte compartment 210. The second anolyte compartment 210 may include one or more inlets 218, 219 and outlets 220. In one embodiment, the second anode 214 is removably positioned within the second anolyte compartment 210. This configuration may facilitate harvesting elemental Sulfur from the second anolyte compartment 210, as was discussed in detail above. The second electrolytic cell 200 may include one or more vents (not shown) for venting any gas that may be generated in the second anolyte and second catholyte compartments (210, 212).

The anolyte 216 of the second anolyte compartment 210 may comprise at least one of an alkali metal sulfide and an alkali metal polysulfide. The anolyte 216 includes a polar organic solvent. In one embodiment, the anolyte 216 of the second anolyte compartment 210 includes elemental sulfur. The polar organic solvent dissolves at least one of the alkali metal sulfide and the alkali metal polysulfide. The polar organic solvent also dissolves elemental sulfur. The polar organic solvent may include one or more of N,N-dimethylaniline, quinoline, tetrahydrofuran, 2-methyl tetrahydrofuran, benzene, cyclohexane, fluorobenzene, trifluorobenzene, toluene, xylene, tetraglyme, diglyme, isopropanol, ethyl propional, dimethyl carbonate, dimethoxy ether, ethanol and ethyl acetate, propylene carbonate, ethylene carbonate, diethyl carbonate, 1,3-Dimethyl-3,4,5,6-tetrahydro-2-pyrimidinone, Methylformide, and 1,3-Dimethyl-2-imidazolidinone (DMI) and the like. Accordingly, the anolyte 216 of the second anolyte compartment 210 is similar to the anolyte 116 (see FIG. 1) of the first anolyte compartment 110 described in conjunction with the electrolytic cell 100 (see FIG. 1), except that the anolyte 216 may have fewer or substantially no heavy metals. Thus, as with the anolyte in the first anolyte compartment 110 of the first electrolytic cell 100, the addition of elemental Sulfur to the anolyte increases the solubility of the alkali metal sulfides, and in particular the alkali metal polysulfides. As will be discussed below, the second electrolytic cell 200 may be used in a system in conjunction with other electrolytic cells, such as the first electrolytic cell, that may have removed some or all of the heavy metal from the anolyte that eventually enters the second anolyte compartment 210.

A second cathode 222 is positioned within the second catholyte compartment 212. In one embodiment, the second cathode 222 may be made of graphite, iron, steel, stainless steel, or other electronically conductive materials. The second catholyte compartment 212 holds a catholyte 224 that is in communication with the second cathode 212 to allow chemical or electrochemical interaction between the second cathode 222 and the catholyte 224 in the second catholyte compartment 212. The second catholyte compartment 212 may include one or more inlets (not shown) and outlets 226. In one embodiment, the second cathode 222 is removably positioned within the second catholyte compartment 212 to facilitate harvesting metal that may plate thereon. In another embodiment, the second cathode 222 is movable band that continuously or intermittently moves in and out of the second catholyte compartment 212 to allow metal plated on the second cathode 222 to be removed from the second cathode 222. In one embodiment, that metal may include alkali metal such at sodium or lithium. In another embodiment, alkali metal that has reduced at the second cathode 222 may remain in a dissolved state in the catholyte and may be removed using ways known in the art.

The catholyte 224 may comprise an alkali ion-conductive liquid or molten alkali metal. In one embodiment, the ion-conductive liquid comprises one or more of a catholyte solvent containing alkali metal ions. The catholyte 224 may include the same solvents and salts as, and be substantially the same as the catholyte 124 (see FIG. 1) used in the first electrolytic cell 100 (see FIG. 1).

A second separator 228 is positioned between the second anolyte compartment 210 and the second catholyte compartment 212. The second separator 228 is in communication with the anolyte of the second anolyte compartment 210 and the catholyte of the second catholyte compartment 212. In one embodiment, the second separator 228 is an alkali ion-selective separator 228, such that under certain conditions discussed below, select alkali ions may pass through alkali ion-selective separator 228 from the second anolyte compartment 210 to the second catholyte compartment 212. The second separator 228 may be substantially permeable only to cations and substantially impermeable to anions, polyanions, and dissolved sulfur.

In one embodiment, the alkali ion-selective separator 228 is a Sodium Super Ionic Conductor (NaSICON). In one embodiment, the second separator 228 has a composition of $Na_{1+x}Zr_2Si_xP_{3-x}O_{12}$ where $0<x<3$. Other NaSICON compositions are known in the art. In another embodiment the alkali ion-selective separator 228 is a Lithium Super Ionic Conductor (LiSICON). In another embodiment, the second separator 228 may be lithium titanium phosphate (LTP) with a composition that is substantially, $Li_{(1+x+4y)}Al_xTi_{(1-x-y)}(PO_4)_3$ where $0<x<0.4$ and $0<y<0.2$. Other suitable materials may be from the ionically conductive glass and glass ceramic families such as the general composition $Li_{(1+x+4y)}Al_xGe_{2-x}PO_4$. Other lithium conductive materials are known in the art. It will be appreciated by those of skill in the art that the choice of alkali ion-selective separator 228 is dependent upon what alkali metal is desired to be recovered. In one embodiment, the alkali ion-selective second membrane 228 includes beta' alumina. The ion-selective second membrane 228 may include alkali metal conductive glass.

The alkali ion-selective separator 228 may have a portion of its thickness which has negligible through porosity such that liquids in the second anolyte compartment 210 and second catholyte compartment 212 cannot pass from one compartment to the other, but substantially only alkali ions (Mt), such as sodium ions or lithium ions, can pass from the second anolyte compartment 210 to the second catholyte compartment 212. The second separator 228 may also be comprised in part by an alkali metal conductive glass-ceramic such as the materials produced by Ohara Glass of Japan.

The second electrolytic cell 200 also includes a second power source 234 in electrical communication with the second anode 214 and the second cathode 222. In one embodiment, the second power source 234 is a direct current power supply 234. The second anode 214 is connected to the positive terminal of the direct current power supply 234 and the second cathode 22 is connected to the negative terminal of the direct current power supply 234. The second power source 234 is configured to apply a voltage to the second electrolytic cell 200 that is greater than the open circuit potential of the second electrolytic cell. It will be appreciated by those of skill in the art that under certain conditions relative to the concentration of particular ions in the system, this voltage will cause alkali metal ions to reduce in the second catholyte compartment 212 when they pick up an electron. Accordingly, the second electrolytic cell 200 of the present invention may be configured with sensors, controllers, monitors, regulators, flow meters, access ports, and alert mechanisms such as those described above in conjunction with the first electrolytic cell, to allow the concentration and ratio of constituents such as alkali metal, elemental Sulfur, heavy metal, solvents, oxidation states, open cell voltage and the like, to be monitored, measured, and maintained. The second electrolytic cell 200 of the present invention may also be configured with monitors and controllers to monitor, measure and maintain, predetermined voltages applied to the second electrolytic cell 200 by the second power source 234.

In one embodiment, the power source 234 is configured to apply a voltage to the second electrolytic cell 200 that is sufficient to increase the oxidation state of at least one sulfide ion in the second electrolytic cell 200. Increasing the oxidation state of at least one sulfide ion may mean increasing a monosulfide ion into a polysulfide ion. It may also mean creating a higher polysulfide. For example, the voltage may drive the monosulfide $S^{2-}$ to the polysulfide $S_2^{2-}$, or the polysulfide $S_4^{2-}$ to a higher polysulfide such as $S_6^{2-}$ or $S_8^{2-}$. In one embodiment, the voltage may drive higher polysulfides to elemental sulfur.

In an embodiment where the alkali metal of the alkali metal sulfide or polysulfide is sodium, the ratio of sodium to Sulfur in the second anolyte compartment 210 is, or may be maintained, such that the open circuit potential of the second electrolytic cell 200 is greater than 2.3V. It will be appreciated by those of skill in the art that under these conditions, sodium metal ions that pass from the second anolyte compartment 210 to the second catholyte compartment 212 through the second separator 228 and will reduce to sodium metal in the catholyte compartment 212 when it picks up electrons. It will be appreciated by those of skill in the art that under these conditions with this voltage, sulfide ions in the second anolyte compartment 210 will also oxidize and form elemental sulfur.

In an embodiment where the alkali metal of the alkali metal sulfide or polysulfide is lithium, the ratio of lithium to Sulfur in the second anolyte compartment 210 is, or may be maintained, such that the open circuit potential of the second electrolytic cell 200 is greater than 2.63V. It will be appreciated by those of skill in the art that under these conditions, lithium metal ions that pass from the second anolyte compartment 210 to the second catholyte compartment 212 through the second separator 228, will reduce to lithium metal in the second catholyte compartment 212. It will further be appreciated by those of skill in the art that under these conditions with this voltage, sulfide ions in the second anolyte compartment 210 will also oxidize and form elemental sulfur. In one embodiment, the voltage applied to the second electrolytic cell 200 ranges from 2.3V and 5V.

Accordingly, when voltages sufficient to reduce alkali ions to alkali metal is applied to the second electrolytic cell 200, the positively charged alkali metal ions $M^+$ are attracted to the second cathode 222 and pass through the alkali ion-selective second separator 228 into the second catholyte compartment 212 where they will reduce and form alkali metal. It will be appreciated by those of skill in the art that a voltage sufficient to reduce alkali metal ions would also be sufficient to reduce any heavy metals in the second anolyte compartment 210. However, because the second separator 228 is selective to only alkali ions, any heavy metal ions in the second anolyte compartment 210 will not pass through the alkali ion-selective second separator 228 and will not reduce to heavy metal in the second catholyte compartment 212. Thus, second electrolytic cell 200, is configured to be easier to harvest the alkali metal without the interference of any or substantially any heavy metal.

Once alkali metal ions have reduced to alkali metal in the second catholyte compartment 212, the reduced alkali metal may be removed from the system in a variety of ways. As discussed above, the cathode, in this case the second cathode 222 may be removed from the second catholyte compartment 212 and scraped, heated, chemically or electrochemically processed to remove or otherwise separate the plated alkali metal from the second cathode 22. In one embodiment where the alkali metal has been reduced, but remains in the catholyte, the alkali metal may be harvested or removed from the system by siphoning off an alkali metal-rich layer that has formed in the first catholyte compartment 212. Depending upon the relative specific gravities of the alkali metal and the surrounding catholyte 224 in the first catholyte compartment 212, the alkali metal may form a layer near the top or the bottom of the first catholyte compartment 212 that may be removed. Depending upon the characteristics of the catholyte, other ways to harvest or separate out the alkali metal may be used. In certain embodiments, for example where the catholyte 224 is a solvent containing alkali ions and the reduced alkali metal is in the form of molten alkali metal droplets, the reduced alkali metal may be removed from the first catholyte compartment 212 by flowing the catholyte 224 with alkali metal droplets and separating them in a vessel outside the second electrolytic cell 200. In other embodiments, the catholyte 224 may be passed through a filter, coalescing the alkali metal droplets for easier removal.

Once elemental sulfur is formed in the second anolyte compartment 210, it may be removed by ways know in the art. In one non-limiting example, a cooling apparatus such as a cooling loop (not shown) may be used. Coolant may enter into the second anolyte compartment 210 through conduits (not shown) positioned within the second anolyte compartment 210. When cooled, the solubility of elemental Sulfur decreases with a greater specific gravity than the surrounding anolyte 216, settles to the bottom of the second anolyte compartment 210 where it may flow from the second anolyte compartment 210 through an outlet (not shown). Alternatively the cooling loop may cool the anolyte below the freezing point of elemental Sulfur and elemental Sulfur crystals may form which settle to the bottom of the second anolyte compartment 210, from which they may conveyed away through a configuration of conduits, pumps, valves and/or filters (not shown) in combination with one or more outlets 220. The anolyte 216 containing elemental Sulphur may be removed from the cell and then cooled resulting in precipitation of the sulfur. Alternatively the elemental Sulfur may be separated from the anolyte 216 through other means such as filtration or centrifugation. In one embodiment, the elemental sulfur may allowed to reach saturation within the second anolyte compartment 210 resulting in the formation of a second liquid phase (not shown) which could be drained or otherwise removed from the second electrolytic cell 200.

In one embodiment, the second electrolytic cell 200 includes a heater 236 in operable communication with at least one of the second anolyte and second catholyte compartments (210, 212). In one embodiment, the heater 236 heats the second catholyte compartment 212 and allows the system to operate at a temperature below melting point of the alkali metal in the at least one alkali metal sulfide and alkali metal polysulfide. In this embodiment, the molten alkali metal in the second catholyte compartment 212 facilitates the plating of alkali metal at the second cathode 222. The heater 236 may also heat the second anolyte compartment 210 to facilitate the dissolving of the alkali metal sulfide or polysulfide in the presence of elemental sulfur. In one embodiment, the heater 236 allows the system and/or second electrolytic cell 200 to operate at a temperature ranging from 100° C. to 160°. In another embodiment, the heater 236 allows the system and/or second electrolytic cell 200 to operate at a temperature ranging from 120° C. to 150°.

The second electrolytic cell 200 may include a turbulence promoter 238 within the second anolyte compartment 238 to improve mass transfer properties within the second anolyte compartment 210. The turbulence caused by the turbulence promoter may improve mass transfer in the second electrolytic cell 200 by diminishing the boundary layer at the second separator 228 and increasing ion transport. The second anode 214 may operate as the turbulence promoter 238 and the second anode may be of the same type and configuration as the anode 114 in the electrolytic cell 100 described in conjunction with FIG. 1. It will be appreciated by those of skill in the art that turbulence promoters of the type described herein, or other turbulence promoters known in the art, may be used in any of the electrolytic cells described herein, in either the anolyte of catholyte compartments of those cells.

As will be discussed in greater detail below, the second anolyte compartment 210 may be configured to recycle a portion of the anolyte 216 contained therein to improve cell 200 performance. In this embodiment, an outlet 220 of the second anolyte compartment 210 may be in fluid communication with an inlet 218, 219 of the second anolyte compartment 210 to allow some or all of the anolyte 216 to leave and enter the same second anolyte compartment 210 one or more times. Recycling anolyte through the same compartment may increase the velocity of flow. It will be appreciated by those of skill in the art that increased flow velocity may improve mass transfer in the second electrolytic cell 200 by diminishing the boundary layer at the second separator 128 and increasing ion transport. It will further be appreciated by those of skill in the art the inlets and outlets to allow for such recycling to increase flow velocity may be used in any of electrolytic cells described herein, in either the anolyte of catholyte compartments of those cells.

Figure 3:
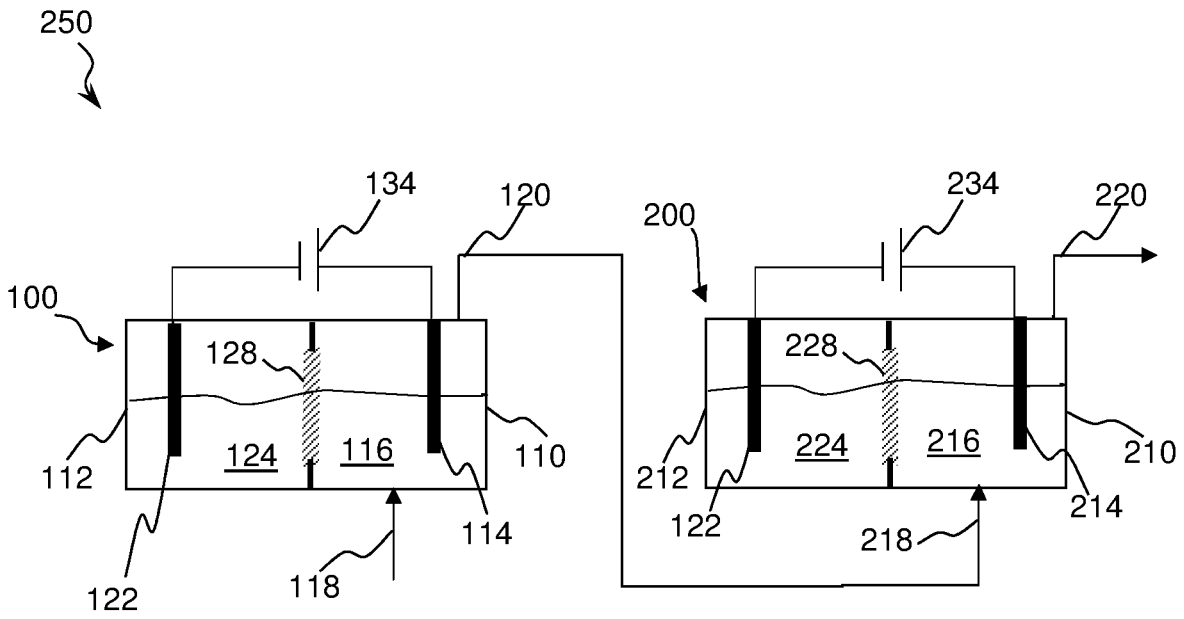
FIG. 3 is a high-level block diagram showing a sodium-sulfur removal system using two electrolytic cells.

Referring now to FIG. 3, one embodiment of a system 250 for removing metal and elemental Sulfur from a feed stream is shown using a first electrolytic cell 100 and a second electrolytic cell 200 in combination. The first electrolytic cell 100 may be the same or similar to the first electrolytic cell 100 and all its various embodiments described above in conjunction with FIG. 1 above. The second electrolytic cell 200 may be the same or similar to the second electrolytic cell 200 and all its various embodiments described above in conjunction with FIG. 2 above. In one embodiment of system 250, the first electrolytic cell 100 is in fluid communication second electrolytic cell 200.

In one embodiment of the two-cell system 250, the first power source 134 is configured to apply a voltage to the first electrolytic cell 100 that is below the open cell potential of the first electrochemical cell 100. In another embodiment, the first power source 134 is configured to apply a voltage to the first electrolytic cell 100 that is at least 0.2V below the open cell potential of the first electrochemical cell. The first power source 134 may also be configured to apply a voltage to the first electrolytic cell 100 that is insufficient to reduce alkali metal ions in the first electrolytic cell 100 to alkali metal. In one embodiment, the voltage applied to the first electrolytic cell 100 ranges between about 0.7V and about 2.0V. Accordingly, the voltage applied to the first electrolytic cell 100, is sufficient to reduce heavy metal ions to heavy metal, but not alkali metal ions to alkali metal.

As discussed above, when voltage is applied to the first electrolytic cell 100, heavy metal ions, attracted to the first cathode 122, move from the first anolyte 116 through the first separator 128 and combine with electrons in the first catholyte 124 to reduce to heave metal. This may occur at the first cathode 122 where heavy metal plates onto the first cathode 122. The heavy metal can then be removed from the system 250 by ways discussed above in conjunction with FIG. 1.

In one embodiment of system 250, an outlet 120 of the first anolyte compartment 110 of the first electrolytic cell 100 is in fluid communication with an inlet 218 of the second anolyte compartment 210 of the second electrolytic cell 200. In this configuration, the original feed stream or anolyte that has had heavy metals removed from it by the electrolytic cell 100, is fed into the second electrolytic cell 200. With much, if not substantially all, of the heavy metal contaminants removed, the anolyte can be further processed by the second electrolytic cell to separate and recover the alkali metal and elemental Sulfur. Because the second power source 234 applies a voltage to the second electrolytic cell that is sufficient to reduce alkali metal ions to alkali metal, when the alkali metal ions combine with electrons in the second anolyte compartment 216, the alkali ions that are dissolved in the anolyte solvent in the second anolyte compartment 210 can migrate through the alkali ion-selective second membrane 228 and reduce to alkali metal in the second catholyte compartment 212. The alkali metal in the second catholyte compartment 212 can be harvested in any number of ways known in the art, including those discussed above in conjunction with the descriptions of FIGS. 1 and 2 above.

As discussed above in conjunction with FIG. 2, the voltage applied to the second electrolytic cell 200 of the system 250 is high enough to increase the oxidation state of at least one sulfide ion in the second anolyte compartment 210. In one embodiment, the voltage is high enough to drive the oxidation of sulfide ions all the way to elemental sulfur. Elemental Sulfur can be separated from the anolyte 216 of second anolyte compartment 210 by means discussed above in conjunction with FIGS. 1 and 2, and then removed from the second electrolytic cell 200 utilizing outlet 220. In another embodiment, anolyte containing elemental Sulfur can be remove from the second anolyte compartment 210 through outlet 220 and undergo a separation process to remove the elemental Sulfur outside the electrolytic cell 200.

In one embodiment, the system 250 comprises a heater (not shown) in operable communication with at least one of the first and second anolyte compartments (110 and 210) and the first and second catholyte compartments (112 and 212). The system heater in some embodiments may take the place of the individual heater of electrolytic cell 100 or 200. In one embodiment, the system 250 is configured to operate at a temperature below the melting point of the alkali metal in the at least one alkali metal sulfide and alkali metal polysulfide of the anolyte of the first anolyte compartment 110 or the second anolyte compartment 200. In this embodiment, the ion conducting liquid of the catholyte of the first catholyte compartment 112 or the second catholyte compartment 212 may be molten alkali metal. In one embodiment, the molten alkali metal is molten sodium. In another embodiment, the molten alkali metal is molten lithium. In another embodiment, the system 250 includes a heater in operable communication with at least one of the first and second anolyte compartments (110 and 210) and the first and second catholyte compartments (112 and 212), and wherein the system 250 is configured to operate at a temperature ranging from 100° C. to 160°. In another embodiment, the system 250 is configured to operate at a temperature ranging from 120° C. to 150°. Depending upon the existence of a heater or the heater configuration, the ion-conductive liquid of the first and second catholyte compartments (112 and 212) comprises at least one of a catholyte solvent containing alkali metal ions and molten alkali metal.

Figure 4:
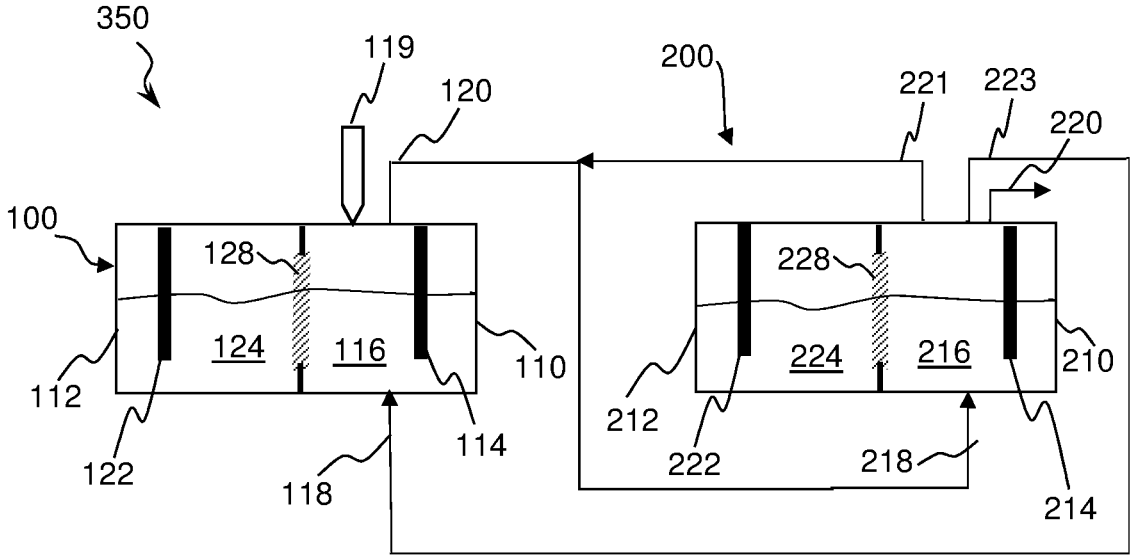
FIG. 4 is a high-level block diagram showing another embodiment of a sodium-sulfur removal system using two electrolytic cells.

Referring now to FIG. 4, a system 350 includes another embodiment of the combination of the first electrolytic cell 100 and the second electrolytic cell 200. An outlet 120 of the first anolyte compartment 110 is in fluid communication with an inlet 218 of the second anolyte compartment 210 such that the two electrolytic cells (100, 200) are in fluid communication with each other. As with system 250 (FIG. 3), this configuration of system 350 allows for the removal of heavy metals from the anolyte in the first electrolytic cell 100 using processes described above, followed by removal of sodium and elemental Sulfur from the same anolyte, now in the second electrolytic cell 200. In this embodiment of the present invention, an outlet 221 of the second anolyte compartment 210 may be in fluid communication with an inlet 218 of the same second anolyte compartment 210. This configuration allows anolyte 216 to be continuously or intermittently recycled through the second anolyte compartment 210. Those of skill in the art will appreciate that the increased interaction between the anolyte and the separator 228 caused by such recycling will increase the mass transfer properties of the anolyte within the second anolyte compartment 210 and increase the efficiency of the electrolytic cell 200. It will further be appreciated by those of skill in the art that all of the embodiments of anolyte compartments and catholyte compartments described in this specification may include this recycling feature where outlets are in fluid communication with inlets of the same compartment.

The system 350 of the present invention may also include an outlet 223 of the second anolyte compartment 210 in fluid communication with an inlet 118 of the first anolyte compartment 110. This will allow the system 350 to run in continuous mode. In this configuration, heavy metals may be removed from the anolyte, which may be the original feed stream, in the first electrolytic cell 100. Then sodium and elemental Sulfur may be removed from the same anolyte, now with less heavy metal, in the second electrolytic cell 200. And then the anolyte with less heavy metal, and now with less alkali metal and elemental Sulfur, can be moved from the second electrolytic cell 200 and fed back into the first electrolytic cell 100 for further removal of any heavy metal that may still remain in the anolyte cycling through the system 350. The pattern may repeat such that the removal of heavy metal, sodium metal and elemental Sulfur may be accomplished incrementally from the respective anolyte compartments (110, 210) of the respective electrolytic cells (100, 200). In this embodiment, a separate input 119 may be included to add original or additional feed stream, original or additional elemental sulfur, original or additional solvent, and the like to the system 350 by way of the first anolyte compartment 110 of the first electrolytic cell 100. It will be appreciated by those of skill in the art, that original or additional feed stream may be introduced into the system via the second anolyte compartment 210 of the second electrolytic cell 200. In this embodiment, an additional inlet (not shown) to the second analytic compartment 210 may be utilized to introduce original or additional feed stream, as well as original or additional elemental sulfur, original or additional solvent, and the like.

It will be appreciated by those of skill in the art that systems 250 and 350, and indeed all embodiments of anolyte and catholyte compartments, may be configured with multiple inlets and outlets in a variety of configurations to accomplish the teachings of the invention. In one nonlimiting example, the outlets 220, 221, and 223 of system 350 may be the same outlet controlled electronically or manually by valve. Additionally, in some embodiments, pumps (not shown) and/or filters (not shown) of a kind known in the art may be used to facilitate flow of catholyte or anolyte through the systems and compartments described throughout this description. Further, access to all embodiments of anolyte and catholyte compartments, and systems generally may be accomplished by any number of inlets, outlets, or access points known in the art.

Figure 5:
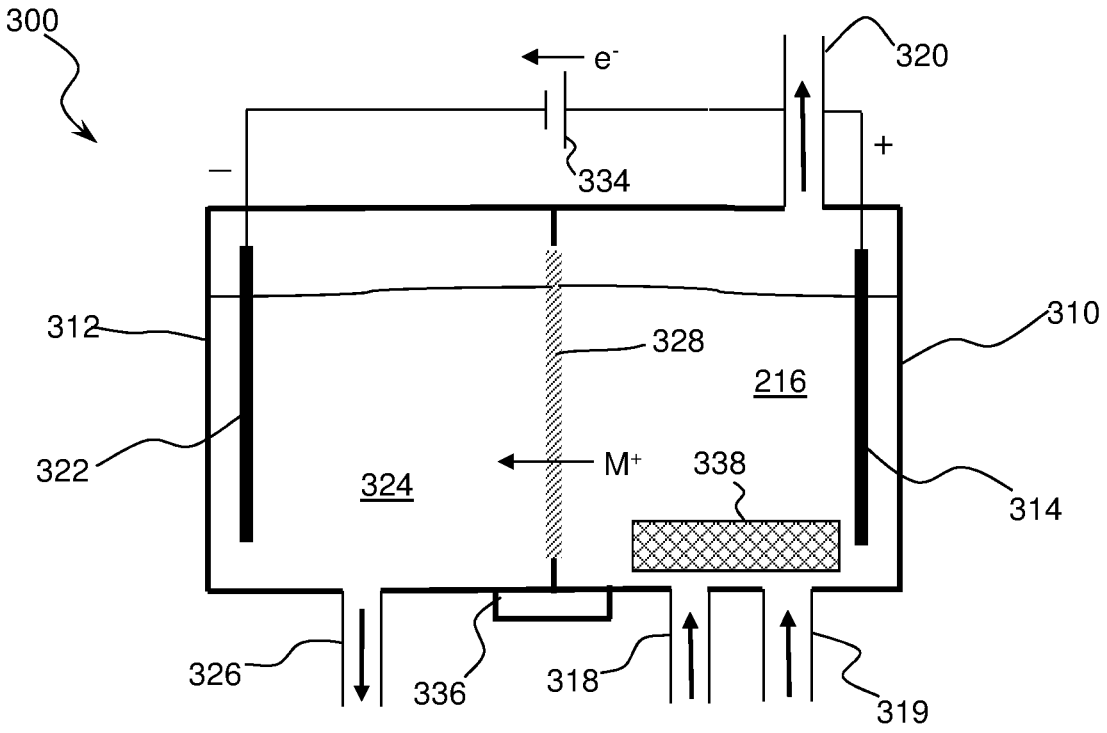
FIG. 5 is a high-level block diagram showing another embodiment of an electrolytic cell used in the sodium-sulfur removal system of the present invention.

Referring now to FIG. 5, a third electrolytic cell 300 is shown. As will be discussed in more detail below, the third electrolytic cell 300 may be used in a system in conjunction with the first electrolytic cell 100 (see FIG. 1) and the second electrolytic cell 200 (see FIG. 2). The third electrolytic cell 300 includes a third anolyte compartment 310 and a third catholyte compartment 312. A third anode 314 is positioned within the third anolyte compartment 310. In one embodiment, the third anode 314 is substantially the same as the second anode 214 of the second anolyte compartment 210 of the second electrolytic cell 200 with its various embodiments. The third anolyte compartment 310 holds an anolyte 316 that is in communication with the third anode 314 to allow chemical or electrochemical interaction between the third anode 314 and the anolyte 316 within the third anolyte compartment 310. The third anolyte compartment 310 may include one or more inlets 318, 319 and outlets 320.

A third cathode 322 is positioned within the third catholyte compartment 312. In one embodiment, the third cathode 322 may be substantially similar to the second cathode 212 of the second catholyte compartment 212 of the second electrolytic cell 200 with its various embodiments. The third catholyte compartment 312 holds a catholyte 324 that is in communication with the third cathode 312 to allow chemical or electrochemical interaction between the third cathode 322 and the catholyte 324 in the third catholyte compartment 312. The third catholyte compartment 321 may include one or more inlets (not shown) and outlets 326.

The third anode 314 and the third cathode 322 may be positioned within their respective third anolyte compartment 310 and third catholyte compartment 312 and function in the same or similar way as the second anode 214 and second cathode 222 described in conjunction with FIG. 2. Further, the anolyte 316 and the catholyte 324 may be the same as or substantially similar to the respective anolyte 216 and catholyte 224 of the second electrolytic cell 200 described in conjunction with FIG. 2 above. Thus, in one embodiment, the anolyte 316 may include at least one of an alkali metal sulfide and an alkali metal polysulfide, and a polar organic solvent that dissolves elemental Sulfur and dissolves the at least one of the alkali metal sulfide and the alkali metal polysulfide. As will be discussed in greater detail below, when used on conjunction with the first electrolytic cell 100 and the second electrolytic cell 200, the anolyte 316 may further include at least a portion of anolyte removed from the second anolyte compartment 210 of the second electrolytic cell 200.

The anolyte 316 may also include elemental Sulfur to help increase the solubility of any alkali metal sulfides or polysulfides in the third anolyte 316. The catholyte 324 may comprise an alkali ion-conductive liquid that may comprise one or more of a catholyte solvent containing alkali metal ions and a bath of molten alkali metal.

A third separator 328 may be positioned between the third anolyte compartment 310 and the third catholyte compartment 312 of the third electrolytic cell 300. In one embodiment, the third separator 328 may be the same separator, positioned in the same way, as the second separator 228 used in the second electrolytic cell 200 with all its various embodiments (see FIG. 2). Thus, the third separator 328 is an alkali ion-selective separator in communication with the third anolyte 316 and the third catholyte 324 and may function in the same or similar way as the second separator 228 described above in conjunction with FIG. 2.

In one embodiment, the third electrolytic cell 300 may include a heater 336 of the same kind and with the same purpose and configuration as the heater 236 and its various embodiments described in conjunction with FIG. 2 above. The third anolyte compartment 310 and third catholyte compartment 312 may also include turbulence promoters of the same kind and purpose as the turbulence promoters and their various embodiments described in conjunction with FIG. 2 above. The third electrolytic cell 300 may include one or more vents (not shown) for venting any gas that may be generated in the third anolyte and catholyte compartments (310, 312). The third anolyte compartment 310 may include an internal or external cooling mechanism (not shown) to facilitate removal of elemental Sulfur as discussed above in connection with the first and second electrolytic cells 100 and 200. The third electrolytic cell 300 also includes a third power source 334 in electrical communication with the third anode 314 and the third cathode 322.

As will be discussed in greater detail below, the third anolyte compartment 310 may be configured to recycle a portion of the anolyte 316 contained therein to improve cell 300 performance. In this embodiment, an outlet 320 of the third anolyte compartment 310 may be in fluid communication with an inlet 318, 319 of the third anolyte compartment 310 to allow some or all of the anolyte 316 to leave and enter the same second anolyte compartment 310 one or more times.

Accordingly, in one embodiment, the third electrolytic cell 300 may be the same or similar as the second electrolytic cell 200 and its various embodiments described in conjunction with FIG. 2 above, except that the third power source 334 of the third electrolytic cell 300 may operate differently from the second power source 234 of the second electrolytic cell 200.

The third power source 334 is configured to apply a voltage to the third electrolytic cell 300 that is sufficient to oxidize sulfide ions to form elemental Sulfur in the third anolyte compartment 316.

It will be appreciated by those of skill in the art that formation of elemental Sulfur and alkali metal is affected by various factors including the particular ion concentration levels in the electrolytic cell 300. Accordingly, the third electrolytic cell 300 of the present invention may be configured with sensors, monitors, controllers, regulators, flow meters, access ports, alert mechanisms and the like (not shown) in the third anolyte compartment 310 and the third catholyte compartment 312, and other features that allow the concentration and ratio of constituents such as alkali metal, elemental Sulfur, heavy metal, solvents, open cell voltages, oxidation states, and the like, to be monitored, measured, and maintained. The third electrolytic cell 300 of the present invention may also be configured with monitors and controllers to monitor, measure and maintain, predetermined voltages applied to the third electrolytic cell 300 by the third power source 334.

In one embodiment, the power source 334 is adjustable according to the current oxidation state of the sulfide ions to be oxidized to be able to provide voltage sufficient to create elemental Sulfur under a variety of ion concentrations or cell conditions. For example, where the oxidation state of the sulfide ions is lower, power requirements may need to be greater or applied for a longer period of time in order to oxidize sulfide ions all the way to elemental Sulfur. Where the sulfide ions are higher polysulfides, power requirements may not need to be as great or applied for as long a period of time in order to oxidize sulfide ions all the way to elemental Sulfur.

In one embodiment, the third electrolytic cell 300 is configured to determine, monitor, regulate, and control the oxidation level of sulfides in the third anolyte compartment 310 and automatically change, or alert a user to manually change, the power source 314 such that the third electrolytic cell can operate more energy efficiently to form elemental Sulfur.

In an embodiment where the alkali metal of the alkali metal sulfide or polysulfide is sodium, the ratio of sodium to Sulfur in the third anolyte compartment 310 is, or may be maintained, such that the open circuit potential of the third electrolytic cell 300 is greater than 2.3V. It will be appreciated by those of skill in the art that under these conditions, sodium metal ions that pass from the third anolyte compartment 310 to the third catholyte compartment 312 through the third separator 228 and will reduce to sodium metal in the third catholyte compartment 312 when the alkali ions combine with electrons. It will be appreciated by those of skill in the art that under these conditions with this voltage, sulfide ions in the third anolyte compartment 310 will also oxidize and form elemental sulfur.

In an embodiment where the alkali metal of the alkali metal sulfide or polysulfide is lithium, the ratio of lithium to Sulfur in the third anolyte compartment 310 is, or may be maintained, such that the open circuit potential of the third electrolytic cell 300 is greater than 2.63V. It will be appreciated by those of skill in the art that under these conditions, lithium metal ions that pass from the third anolyte compartment 310 to the third catholyte compartment 312 through the third separator 328, will reduce to lithium metal in the third catholyte compartment 312. It will further be appreciated by those of skill in the art that under these conditions with this voltage, sulfide ions in the third anolyte compartment 310 will also oxidize and form elemental sulfur. In one embodiment, the voltage applied to the third electrolytic cell 300 ranges from 2.3V and 5V.

It will be appreciated by those of skill in the art that a voltage high enough to reduce alkali metal ions to alkali metal will also sufficient to reduce heavy metal ions to heavy metal. However, because the separator 328 is selective to only alkali ions, any heavy metal ions in the third anolyte compartment 310 will not pass through the alkali ion-selective separator 328 and will not reduce to heavy metal in the third catholyte compartment 312.

Figure 6:
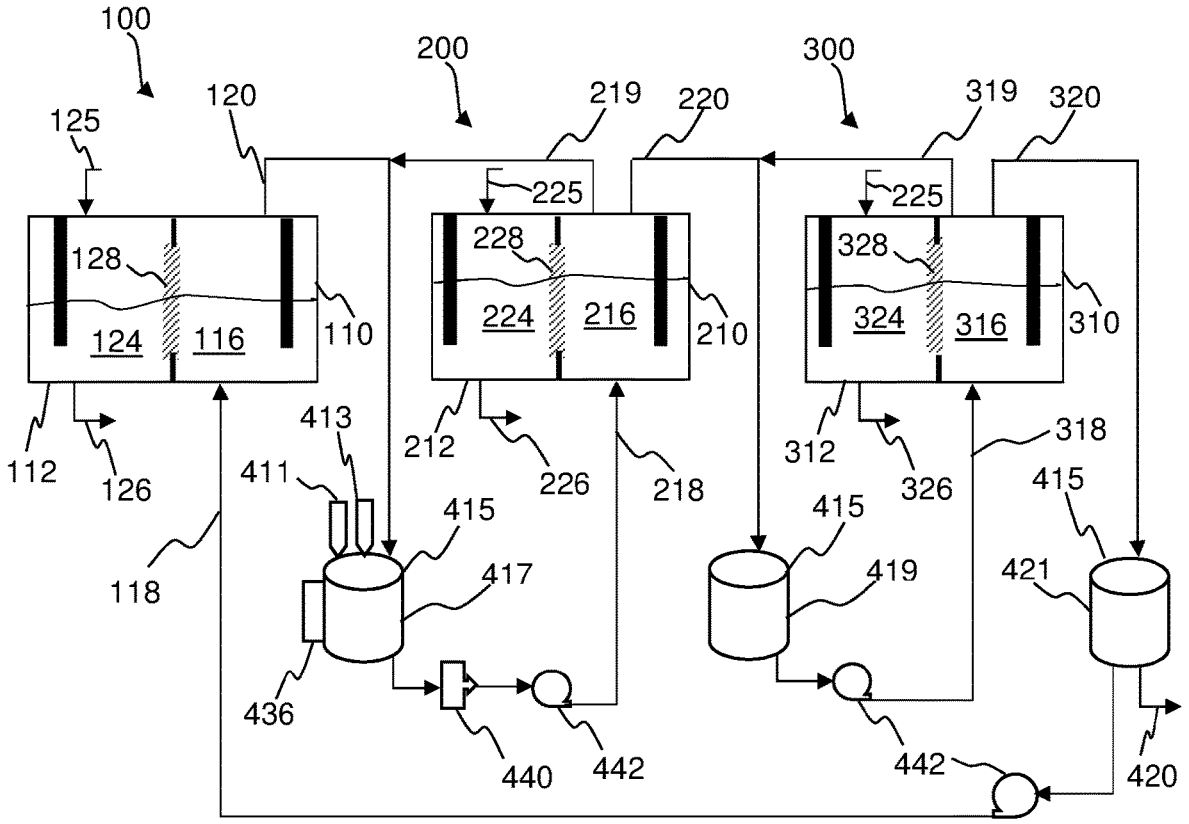
FIG. 6 is a high-level block diagram showing another embodiment of a sodium-sulfur removal system using multiple electrolytic cells.

Referring now to FIG. 6, three electrolytic cells are arranged in a system 450. In one embodiment the three cells include the first electrolytic cell 100, the second electrolytic cell 200, and third electrolytic cell 300. The electrolytic cells (100, 200, 300) are in fluid communication with each other. In one embodiment of system 450, the outlet 120 of the first anolyte compartment 110 of the first electrolytic cell 100 is in fluid communication with the inlet 218 of the second anolyte compartment 210 of the second electrolytic cell 200. The outlet 220 of the second anolyte compartment 220 of the second electrolytic cell 200 is in fluid communication with the inlet 318 of the third anolyte compartment 310 of the third electrolytic cell 300. Reference to "system anolyte" includes anolyte that may be processed in one or more of the electrolytic cells 100, 200 and 300, or that moves throughout the system 450.

In the configuration of 450, original feed stream or a system anolyte that has had heavy metal removed from it by the electrolytic cell 100, can be feed into the second electrolytic cell 200. With much if not substantially all of the heavy metal contaminants removed, the system anolyte can be further processed by the second electrolytic cell 200 to separate and recover the alkali metal and to grow polysulfides without or substantially without interference from heavy metal ions. Because the second power source 234 applies a voltage to the second electrolytic cell 200 that is sufficient to reduce alkali metals, the alkali ions can migrate through the alkali ion-selective membrane 228 and reduce to alkali metal in the second catholyte compartment 212. The alkali metal can be harvested in any number of ways known in the art, including those discussed above in conjunction with the description of FIG. 1.

As discussed above, the voltage applied to the second electrolytic cell 200 of the system 450 is high enough to increase the oxidation state of at least one sulfide ion in the second anolyte compartment 210, but not high enough to substantially drive sulfide ions or polysulfide ions all the way to elemental sulfur. In one embodiment, where the alkali metal in at least one of the alkali metal sulfide and alkali metal polysulfide in the second anolyte compartment comprises sodium, and the ratio of sodium to sulfur in the second anolyte compartment of the second electrolytic cell is, or may be maintained, such that the open circuit potential of the second electrolytic cell is less than or equal to 2.2V. In one embodiment, where the alkali metal in at least one of the alkali metal sulfide and alkali metal polysulfide in the second anolyte compartment comprises lithium and the ratio of lithium to sulfur in the second anolyte compartment of the second electrolytic cell is, or may be maintained, such that the open circuit potential of the second electrolytic cell is less than or equal to 2.53V.

In one embodiment, the sensors, monitors, regulators, controllers, alert mechanisms and the like (not shown) of the second electrolytic cell 200 in the system 450, together with the power source 234 (not shown) are configured to interact with each other to maintain the amount of sulfides in the sulfide or polysulfide ions in the second anolyte compartment 210 of the second electrolytic cell 200 at less than or equal to 8. In another embodiments, the second electrolytic cell 200 is configured to maintain the amount of sulfides in the polysulfide ions in the second anolyte compartment 210 of the second electrolytic cell 200 in the range from 2 to 7. In another embodiment, the electrolytic cell 200 may alert a user that a predetermined number or range of sulfides in the sulfide or polysulfide ions in the second anolyte compartment 210 of the second electrolytic cell 200 is less than or equal to 8, or within a range from 2 to 7, or 4 to 7.

Thus, in the flow of system anolyte through the system 450, anolyte that has passed through electrolytic cells 100 and 200 now have had both heavy metal and alkali metal removed from it. This system anolyte will also have longer polysulfide chains in it. The system anolyte can then be moved into electrolytic cell 300. Because the voltage applied to the third electrolytic cell is high enough to oxidize higher or longer polysulfides, the system anolyte can be further processed by the third electrolytic cell to create elemental Sulfur, which can be harvested in any number of ways know in the art, including those discussed above in conjunction with the description of FIG. 5 above. In particular monitoring the ratio of alkali metal ion to sulfur content and monitoring open circuit potentials will aid in optimizing the utilization of the cells such that alkali metal produced in the first electrolytic cell 100 is minimal and production of elemental sulfur in the third electrolytic cell 300 is maximized.

In one embodiment of system 450, the first electrolytic cell 100 may include a first catholyte compartment 112 with an inlet 125 and an outlet 126 for introducing catholyte 124 into the catholyte compartment 112 and removing catholyte or reduced metal from the first catholyte compartment 112. The first electrolytic cell 100 may include a first anolyte compartment 110 with an input 118 and an output 120 for introducing anolyte 116 into the first anolyte compartment 110 and removing anolyte or other constituents from the first anolyte compartment 110. The anolyte 116 may be system anolyte. A separator 128 separates the first anolyte compartment 110 and the first catholyte compartment 112. When power is applied to the first cell 100 heavy metal cations in the anolyte 116 pass through the separator 128 into the first catholyte compartment 112. The remaining spent anolyte may exit the first anolyte cell 110 through outlet 120 and pass to a tank 415 having an inlet in fluid communication with an outlet of the first anolyte compartment 110 of the first electrolytic cell 100 and an outlet in fluid communication with the second electrolytic cell 200. As used herein throughout, "spent anolyte" may include any anolyte that has had constituents removed from it. The case of anolyte received from the first electrolytic cell, metal may have removed from the anolyte. In this embodiment, the tank 415 may be a dissolving tank 417. The dissolving tank may include an input 419 and an input 421. In one embodiment, a feed stream with sulfide-rich or alkali metal monosulfide- or alkali metal polysulfide-rich solids may be input into the system 450 through input 419. Elemental Sulfur may be loaded into input 421. Spent anolyte from the second anolyte compartment 210 may be removed from the second anolyte compartment 210 through outlet 219 and fed into the dissolving tank 417. The anolyte may be "spent" because of sodium metal removed from the anolyte in the second electrolytic cell 200. The elemental Sulfur helps dissolve alkali metal sulfide or polysulfide to a higher concentration than would be possible without the elemental sulfur.

The dissolving tank 417 may include a heater 436 in operable communication with the dissolving tank 417. The system anolyte in the dissolving tank includes a non-aqueous polar solvent that has elemental Sulfur solubility at elevated temperature. The steady state temperature in the dissolving tank 417 may be in the range of about 100° C. to about 160° C. In another embodiment, the steady state temperature in the dissolving tank 417 may be in the range of about 120° C. to about 150° C. At these temperatures, both elemental Sulfur and solids solubilities are high. Compared to the spent anolyte coming from the first electrolytic cell 100, the alkali metal content and elemental Sulfur content of the system anolyte in the dissolving tank 417 is higher. The system 450 may include a system heater that in some embodiments may take the place of heater used in electrolytic cells 100, 200, or 300. In one embodiment, the system 450 is configured to operate at a temperature below the melting point of the alkali metal in the at least one alkali metal sulfide and alkali metal polysulfide of the anolyte of the first anolyte compartment 110, the second anolyte compartment 210, or the third anolyte compartment 310. In this embodiment, the ion conducting liquid of the catholyte of the first catholyte compartment 112, the second catholyte compartment 212, or the third catholyte compartment 312 may be a molten alkali metal bath. In one embodiment, the molten alkali metal bath is a molten sodium bath. In another embodiment, the molten alkali metal bath is a molten lithium bath. In another embodiment, the system 450 includes a heater (not shown) that is configured to operate the system 450 at a temperature ranging from 100° C. to 160°. In another embodiment, the system 450 is configured to operate at a temperature ranging from 120° C. to 150°.

Additionally, in the embodiment of system 450, the concentration of heavy metals such as iron, nickel, vanadium, and other heavy metals are higher in the dissolving tank 417 than in anolyte from the first electrolytic cell 100. This may be the case so long as new or untreated feed stream is added at the point of the dissolving tank 417 through input 419. The system anolyte may exit the dissolving tank 417 and pass through a filter 440 before entering the second anolyte compartment of the second electrolytic cell 200 through inlet 218. In one embodiment, a pump 442 pumps the system anolyte into the second anolyte compartment 210. The filter 440 may be used following any point of entry of solids into the system 450.

In one embodiment of system 450, the second electrolytic cell 200 may include a second catholyte compartment 212 with an inlet 225 and an outlet 226 for introducing catholyte 224 into the catholyte compartment 212 and removing catholyte or reduced metal from the second catholyte compartment 212. The second electrolytic cell 200 includes a first anolyte compartment 210 with an input 218 and an output 220 for introducing anolyte 216 into the second anolyte compartment 210 and removing anolyte or other constituents from the second anolyte compartment 210. The anolyte 216 may be system anolyte. An alkali ion-selective membrane or separator 228 separates the second anolyte compartment 210 and the second catholyte compartment 212. When power is applied to the second electrolytic cell 200 alkali metal cations in the anolyte 216 pass through the alkali ion-selective membrane 228 into the second catholyte compartment 212 and are reduce to alkali metal. Concurrently, sulfide is oxidized in the anolyte compartment 210 such that low polysulfide anions become higher polysulfide anions. The remaining spent anolyte may exit the second anolyte compartment 210 through outlet 219 and pass back into the dissolving tank 417 or forward to another tank 415 having an inlet in fluid communication with the second anolyte compartment 210 of the second electrolytic cell 200 and an outlet in fluid communication with the third electrolytic cell. In this embodiment, the tank may be a holding tank 419. Since alkali metals are transported out of the anolyte in the second electrolytic cell 200, the sodium concentration in the holding tank 419 is lower than in the dissolving tank 417. In one embodiment, the second electrolytic cell 200 may be configured with a heater (not shown) to maintain the second electrolytic cell 200 temperature in the range of about 100° C. to about 160° C. In one embodiment, the second electrolytic cell 200 is configured to maintain the temperature in the range of about 120° C. to about 150° C., a temperature where both Sulfur and solids solubilities are high and where sodium is molten.

From the holding tank 419, system anolyte may be fed into the third anolyte compartment 310 of the third electrolytic cell 300. The third electrolytic cell 300 includes a third catholyte compartment 312 with an inlet 325 and an outlet 326 for introducing catholyte 324 into the catholyte compartment 312 and removing catholyte or reduced metal from the third catholyte compartment 312. The third electrolytic cell 300 includes a first anolyte compartment 310 with at least one input 318 and an outputs 319 and 320 for introducing anolyte 316 into the third anolyte compartment 310 and removing anolyte or other constituents from the third anolyte compartment 310. The anolyte 316 may be system anolyte. An alkali ion-selective membrane or separator 328 separates the third anolyte compartment 310 and the third catholyte compartment 312. When power is applied to the third electrolytic cell 300 alkali metal cations in the anolyte 316 pass through the alkali ion-selective membrane 328 into the second catholyte compartment 312 and are reduce to alkali metal. Polysulfides on average are longer in the anolyte of the third anolyte compartment 310, so the open circuit potential of electrolytic cell 300 runs higher than in electrolytic cell 200 such that in electrolytic cell 300, elemental Sulfur is formed in the third anolyte compartment 310 from the oxidation of long polysulfides. As in all cells 100, 200, and 300, the oxidation of sulfides happens concurrently with the reduction of metal cations. In the third anolyte compartment, the anolyte 316, now with sufficiently long polysulfide ions may be oxidized in the third anolyte compartment 310 to create elemental Sulfur.

The remaining spent anolyte may exit the third anolyte compartment 310 through outlet 319 and pass back into the holding tank 419 or forward to another tank 415 having an inlet in fluid communication with the third anolyte compartment 310 of the third electrolytic cell 300 and an outlet in fluid communication with the first electrolytic cell 100. This configuration allows system anolyte to be continuously or intermittently recycled through the second and third anolyte compartments (210 and 310). Those of skill in the art will appreciate that the increased interaction between the system anolyte and the separators 228 and 328 caused by such recycling will increase the mass transfer properties of the system anolyte within the second and third anolyte compartments (210 and 310) and increase the efficiency of the system 450. It will further be appreciated by those of skill in the art that all of the embodiments of anolyte compartments and catholyte compartments described in this specification may include this recycling feature where outlets are in fluid communication with inlets of the same compartment.

The tank 415 may be a separating tank 421. Since alkali metals are removed in part from the anolyte in cell 300, the alkali metal concentration in the anolyte leaving cell 300 is lower than the alkali concentration coming out of the holding tank 415. The separating tank 421 may be used to separate Elemental Sulfur from the system anolyte in any of the ways discussed herein. In one embodiment, the separating tank 421 includes a cooling mechanism such as a cooling loop (not shown), with coolant circulating there through. Alternatively, the separating tank 421 other means for removing or separating elemental Sulfur from the system anolyte, such as filtration or centrifugation mechanisms (not shown). Elemental Sulfur may be removed from the separating tank 421 using outlet 420. In a batch mode, the spent anolyte may be removed from the system 450 using outlet 420.

After Elemental Sulfur has been removed from the system anolyte in the separating tank 421, the system anolyte may be fed back into the first anolyte compartment 110 of the first electrolytic cell 100, and the process or method 450 may be repeated. This will allow the system 450 to run in continuous mode. In this configuration, heavy metals may be removed from the system anolyte, which may be the original feed stream, in the first electrolytic cell 100. Then alkali metal may be removed from the same system anolyte, now with less heavy metal, in the second electrolytic cell 200. And then the system anolyte with less heavy metal, and now with less metal and less sodium metal and longer polysulfide ions, can be moved from the second electrolytic cell 200 to the third electrolytic cell for removal of elemental sulfur. Then the system anolyte may be fed back into the first anolyte compartment 110 of the electrolytic cell 100 for further removal of any heavy metal that may still remain in the anolyte cycling through the system 350. The pattern may repeat such that the removal of heavy metal, sodium metal and elemental Sulfur may be accomplished incrementally from the respective anolyte compartments (110, 210, 310) of the respective electrolytic cells (100, 200, 300), with elemental Sulfur primarily removed from the third electrolytic cell 300.

It will be appreciated by those of skill in the art, that although not shown in FIG. 6, the system 450 may be run in batch mode, where system anolyte is fed into the system 450 at some point, and then passed through the electrolytic cells of that system without repeating the process. By way of non-limiting example, in one embodiment of a batch system configuration, system anolyte is fed into a first electrolytic cell 100 for heavy metal removal and then fed into one or more second electrolytic cells 200. The system anolyte may be recycled through the at least one more second electrolytic cells 200. Some of the system anolyte may pass from one of second electrolytic cells 200 to a subsequent second electrolytic cell 200 while some of the system anolyte recycles through the same electrolytic cell 200. Ultimately, substantially all of the system anolyte is fed into a third electrolytic cell 300. The system anolyte may be recycled at least once through the third electrolytic cell 300 to maximize the harvesting of elemental Sulfur. At some point the process concludes without the system anolyte being fed back into the starting first electrolytic cell 100.

It will be appreciated by those of skill in the art that the electrolytic cells 100, 200, and 300 may be combined in any number of configurations to practice the teachings of this invention. In one non-limiting example of system 450, one embodiment of a system configuration includes multiple second electrolytic cells 200 positioned between a first electrolytic cell 100 and a third electrolytic cell 300. In this configuration, heavy metal may be separated out of the system anolyte in the first electrolytic cell with a voltage that is high enough to reduce the heavy metal ions, but not high enough to reduce the alkali metal ions. Then in the series of multiple second electrolytic cells 200, alkali ions may be separated out incrementally out of the system anolyte under a voltage that is above the decomposition voltage of alkali metal sulfide and polysulfides in the system anolyte such that alkali metal ions are reduced to alkali metal. In this same series of second electrolytic cells 200, the voltage may be high enough to increase the oxidation state of sulfide ions in the anolyte, but not high enough to drive the oxidation reaction of the sulfide ions all the way to elemental Sulfur in a single cell. It will be appreciated by those of skill in the art that with every successive second electrolytic cell 200, the anolyte will have less and less alkali metal, and ever increasing lengths of sulfide ions. For example in the first second electrolytic cell 200, the dissolved sulfide ions may grow from a mono sulfide ions $S^{2-}$ to polysulfide ions $S_2^{2-}$ to $S_4^{2-}$. In a subsequent second electrolytic cell 200, the dissolved sulfide ions may grow into polysulfide ions $S_4^{2-}$ to $S_6^{2-}$. In yet a subsequent second electrolytic cell 200, the dissolved sulfide ions may grow into polysulfide ions $S_6^{2-}$ to $S_8^{2-}$. Then the system anolyte with reduced alkali metal and longer polysulfide ions $S_8^{2-}$ may finally be fed into the third electrolytic cell 300, where the sulfide ions in the form of $S_8^{2-}$ oxidize to form elemental Sulfur. The process may end there as a batch mode configuration, or the system anolyte the process may be configured for continuous mode.

In a continuous mode configuration, the system anolyte, after removal of elemental Sulfur in the final third electrolytic cell 300, may be fed back into the first electrolytic cell 100 where the overall process described above may be repeated. It will be appreciated by those of skill in the art that the combined energy to create elemental Sulfur using this incremental or staged setup of first growing longer polysulfide ions is less than the energy needed to drive a system anolyte containing monosulfide ions or shorter polysulfide ions all the way to elemental Sulfur in single cell.

In other embodiments multiple second cells 200 in series may be interspersed with a first electrolytic cell 100 to periodically remove any heavy metals and then ending with one or more third electrolytic cells 300 to form elemental Sulfur. Multiple third electrolytic cells 300 may be used in series to make sure that a greater number of longer polysulfides in the system anolyte are driven to elemental Sulfur. It will be appreciated by those of skill in the art, that each of the electrolytic cells 100, 200, and 300 may be positioned in series or in parallel at one or more points in the process.

It will be appreciated by those of skill in the art that the tanks 415 may be positioned in a variety of configurations to accomplish the teachings of this invention. Furthermore, one or more of the inlets 419 and 421 may be positioned on the holding tank 419 or any of the anolyte compartments 110, 210, or 310. In one embodiment, feed stream may enter into the system 450 through an inlet 419 attached to the first anolyte compartment 110 of the first electrolytic cell 100. The dissolving tank may be positioned after it and contain the elemental Sulfur inlet 421. The introduction of Sulfur after the first electrolytic cell 100, such that the first anolyte compartment 110 will have less elemental sulfur, may minimize the diffusion of Sulfur across separator 110. In embodiments without a third electrolytic cell 300 configured to be the primary Sulfur remover, separation tank 421 may be positioned after a second electrolytic cell 200. Additionally spent anolyte may need to be recharged because the alkali metal concentration has gone down as it is removed from the system. The presence of additional ions in the system 450 helps the system 450 operate without needed additional energy to move system anolyte through the system 450. Thus the inlet 419 for allowing additional unspent anolyte into the system may need to be strategically places in multiple positions.

Additionally, multiple configurations of pumps 442, filters 440, valves (not shown) and other ingress and egress points to the system 450 are contemplated by, and within the scope of, the present invention. Further, it will be appreciated by those of skill in the art that sensors (not shown), regulators (not shown) and controllers (not shown) may be included in the system 450 for regulating voltage, measuring anolyte and catholyte content at various places within the system, controlling valves, directing flows, controlling flows and the like.

Figure 7:
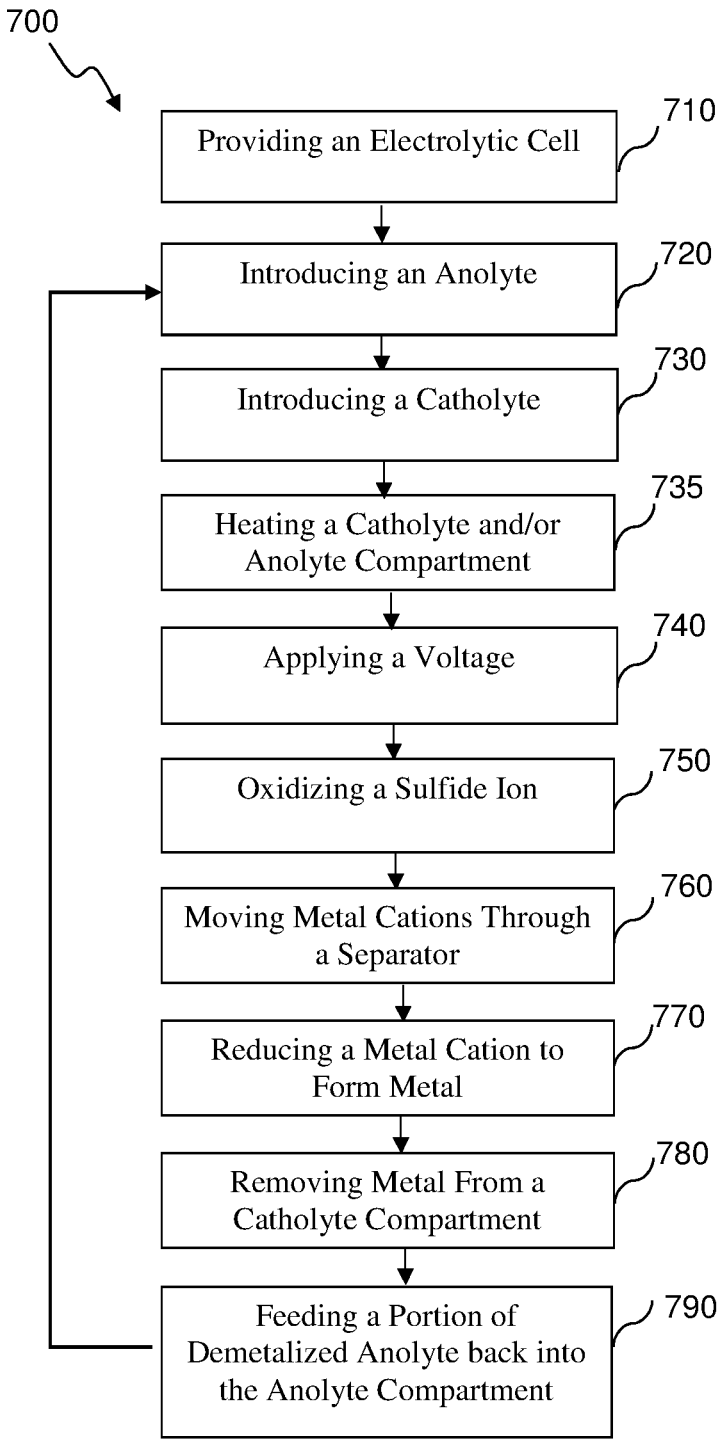
FIG. 7 is a block diagram showing the method steps in the process of removing sodium and Sulfur from a feed stream using a single electrolytic cell.

Referring now to FIG. 7, a method 700 for recovering metal and Sulfur from a feed stream utilizing a single electrolytic cell includes the step of providing 710 an electrolytic cell. The electrolytic cell may be the first electrolytic cell described herein and include a first anolyte compartment configured to hold an anolyte. The first electrolytic cell may include a first anode positioned within the first anolyte compartment in communication with the anolyte. The first electrolytic cell may include a first catholyte compartment configured to hold a catholyte. The first electrolytic cell may include a first cathode positioned within the first catholyte compartment in communication with the catholyte. A first separator of the first electrolytic cell may be positioned between the first anolyte compartment and the first catholyte compartment and be in communication with the anolyte of the first compartment and the catholyte of the first compartment. The first separator is configured to non-selectively transport cations. The first electrolytic cell may also include a first power source in electrical communication with the first anode and the first cathode.

The method 700 includes introducing 720 an anolyte into the first anolyte compartment of the first electrolytic cell. The anolyte may include at least one of an alkali metal sulfide and an alkali metal polysulfide. Introducing 720 an anolyte may also include introducing elemental Sulfur into the first anolyte compartment of the first electrolytic cell. The anolyte also includes a polar organic solvent that dissolves at least one of the alkali metal sulfide, alkali metal polysulfide. Thus, the step of introducing 720 an anolyte, may also include the step of dissolving at least one of an alkali metal sulfide and an alkali metal polysulfide in a polar organic solvent. The solvent also dissolves elemental sulfur. The anolyte may contain a heavy metal, a heavy metal compound, a heavy metal ion, or a combination of these. The method 700 includes introducing 730 a catholyte into the first catholyte compartment of the first electrolytic cell. The catholyte comprises an alkali ion-conductive liquid. In one embodiment, the alkali ion-conductive liquid is a molten alkali metal. In another embodiment, the alkali ion-conductive liquid is a solvent containing alkali metal ions.

In one embodiment, at least one of the first anolyte compartment and the first catholyte compartment is heated 735. It will be appreciated that heat facilitates the dissolving of anolyte and catholyte in the system, creating an increase of ions and increasing cell performance. A voltage may be applied 740 to the first electrolytic cell by the first power source that is sufficient to reduce at least one heavy metal ion to heavy metal. In one embodiment, the voltage applied is sufficient to reduce alkali metal ions in the first electrolytic cell to alkali metal. The step of applying 740 a voltage may include applying a voltage that is sufficient to increase the oxidation state of at least one sulfide ion in the first electrolytic cell. In one embodiment, the step of applying 740 a voltage may include applying a voltage that is sufficient to oxidize at least one sulfide ion to form elemental Sulfur. Thus, the method 700 includes the step of oxidizing 750 at least one sulfide ion in the anolyte of the first anolyte compartment of the first electrolytic cell.

Metal cations are moved 760 through the first separator from the first anolyte compartment to the first catholyte compartment as they are attracted to the first cathode charged by the application of the voltage. The method 700 further comprises the step of reducing 770 at least one of the metal cations moved in the first catholyte compartment to form metal. In one embodiment, the reducing 770 step includes reducing heavy metal cations that move from the first anolyte compartment into the first catholyte compartment into heavy metal. In another embodiment, the reducing 770 step includes reducing alkali metal cations that move from the first anolyte compartment into the first catholyte compartment into alkali metal.

The method 700 includes the step of removing 780 heavy metal from the first catholyte compartment by means discussed in detail above. In one embodiment, the removing 780 step includes removing alkali metal and elemental Sulfur from the first anolyte compartment by means discussed in detail above. The method 700 further includes the step of feeding 790 the anolyte that has had metal and elemental Sulfur removed back into the first anolyte compartment for further processing. The method 700 of recovering metal and elemental Sulfur may further be understood by reference to the system and manner of use described herein in conjunction with FIG. 1.

Figure 8:
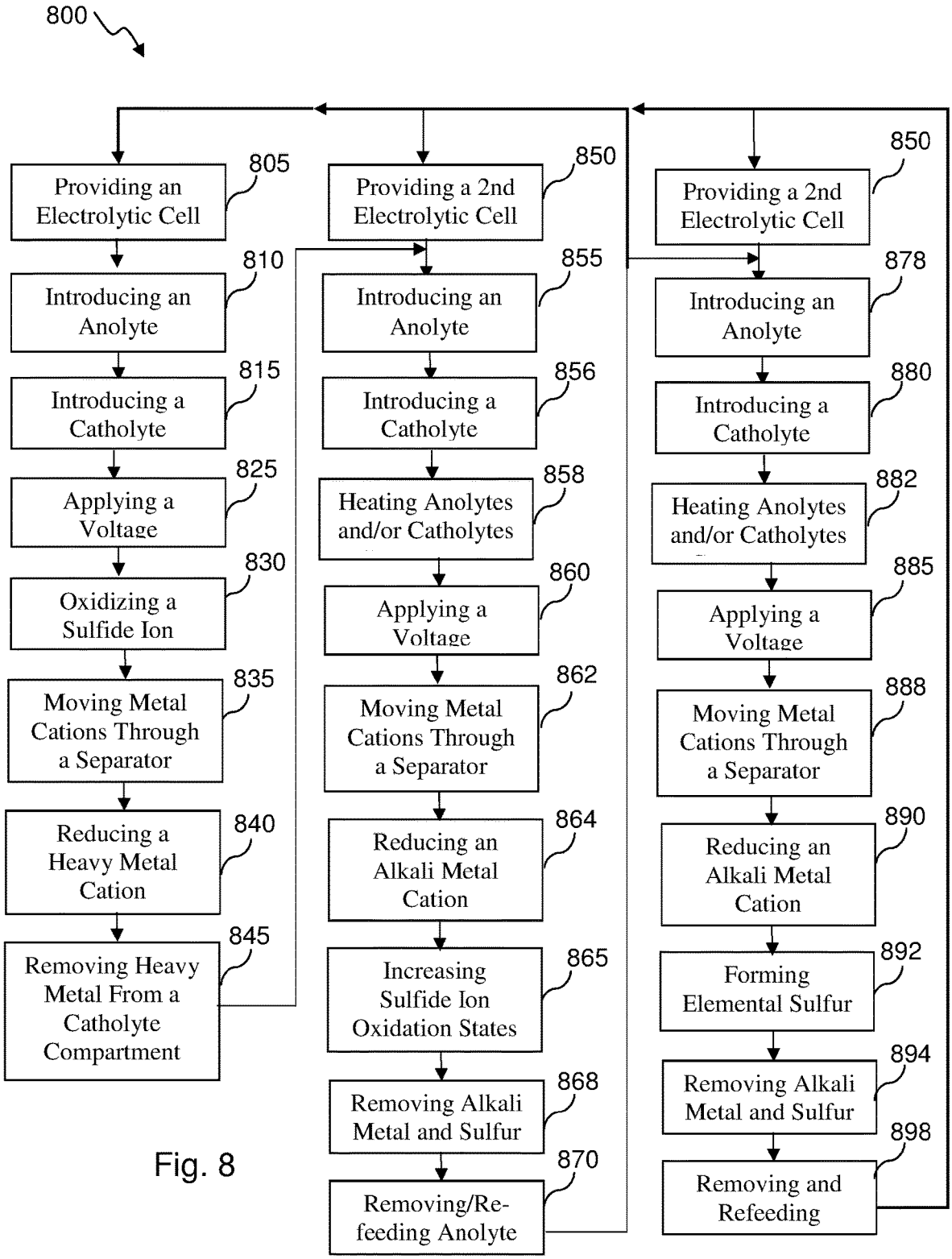
FIG. 8 is a block diagram showing the method steps in the process of removing sodium and Sulfur from a feed stream using a system having multiple electrolytic cells.

Referring now to FIG. 8, a method 800 for recovering metal and elemental Sulfur from a feed stream utilizing a system with multiple electrolytic cells is shown. The method 800 may include steps 710, 720, 730, 740, 750, 760, 770, and 780 of the embodiment shown in FIG. 7. Those steps are respectively shown as 805, 810, 825, 830, 835, 840 and 845 in FIG. 8.

The method includes the step of providing 805 an electrolytic cell. The electrolytic cell may be the first electrolytic cell described herein and include a first anolyte compartment configured to hold an anolyte. The first electrolytic cell may include a first anode positioned within the first anolyte compartment in communication with the anolyte. The first electrolytic cell may include a first catholyte compartment configured to hold a catholyte. The first electrolytic cell may include a first cathode positioned within the first catholyte compartment in communication with the catholyte. A first separator of the first electrolytic cell may be positioned between the first anolyte compartment and the first catholyte compartment and be in communication with the anolyte of the first compartment and the catholyte of the first compartment. The first separator is configured to non-selectively transport cations. The first electrolytic cell may also include a first power source in electrical communication with the first anode and the first cathode.

In one embodiment, an anolyte is introduced 810 into the first anolyte compartment of the first electrochemical cell. The anolyte may be the anolyte of the first anolyte compartment of the first electrolytic cell as described in various places herein. The method 800 includes introducing 815 a catholyte into a first catholyte compartment of the first electrolytic cell. In one embodiment, the catholyte is the catholyte of the first catholyte compartment of the first electrolytic cell as described in various places herein.

A voltage may be applied 825 to the first electrolytic cell. The voltage may be applied 825 by the first power source of the first electrolytic cell. The applied 825 voltage may be sufficient to reduce at least one heavy metal ion in the first electrolytic cell to heavy metal. With the application of voltage, at least one sulfide ion in the anolyte of the first anolyte compartment of the first electrolytic cell may be oxidized 830 to increase the oxidation state of the at least one sulfide ion. The method 800 also includes the step of moving 835 metal cations in the anolyte of the first anolyte compartment through the first separator of the first electrolytic cell into the first catholyte compartment. At least one of the metal cations is then reduced 840 in the first catholyte compartment to form metal.

In one embodiment of the two electrolytic cell configuration, the voltage applied 825 to the first electrolytic cell, while being sufficient to reduce at least one heavy metal ion to heavy metal, is insufficient to reduce alkali metal ions in the first electrolytic cell to alkali metal. Thus, the metal formed in the first catholyte compartment may be just heavy metal. The step of applying 825 voltage to the first electrolytic cell of a 2-cell system may include applying a voltage to the first electrolytic cell that is below the open cell potential of the first electrochemical cell. In another embodiment, the step of applying 825 voltage to the first electrolytic cell of a 2-cell system may include applying a voltage to the first electrolytic cell that is at least 0.2V below the open cell potential of the first electrochemical cell. In another embodiment, the step of applying 825 voltage to the first electrolytic cell of a 2-cell system may include applying a voltage to the first electrolytic cell that ranges between about 0.7V and about 2.0V. By configuring the first electrolytic cell to apply a specific voltage or range of voltages, one could reduce heavy metal ions without reducing alkali metal ions. Thus, heavy metals, which could hinder or interfere with the recovery of alkali metal, can be reduced, plated and removed 845 from the system in the first electrolytic cell before starting the alkali metal separation process.

The method 800 further includes the step of providing 850 a second electrolytic cell in fluid communication with the first electrolytic cell. In one embodiment, the second electrolytic cell is the second electrolytic cell described in conjunction with FIG. 2 above. The second electrolytic cell may include a second anolyte compartment configured to hold an anolyte. The second electrolytic cell may have a second anode positioned within the second anolyte compartment in communication with the anolyte. The second electrolytic cell may include a second catholyte compartment configured to hold a catholyte. The second electrolytic cell may include a second cathode positioned within the second catholyte compartment in communication with the catholyte. A second separator of the second electrolytic cell may be positioned between the second anolyte compartment and the second catholyte compartment and be in communication with the anolyte of the second compartment and the catholyte of the second compartment. The second separator in the second electrolytic cell may be an alkali-ion selective membrane configured to selectively transport alkali ions. The second electrolytic cell may also include a second power source in electrical communication with the second anode and the second cathode.

The method 800 includes the step of introducing 855 an anolyte into the second anolyte compartment of the second electrolytic cell. The anolyte may include at least one of an alkali metal sulfide and an alkali metal polysulfide, a polar organic solvent that dissolves at least one of the alkali metal sulfide, alkali metal polysulfide, and that dissolves elemental sulfur. In one embodiment, the step of introducing 855 anolyte into the second anolyte compartment of the second electrolytic cell includes removing at least a portion of the anolyte from the first anolyte compartment of the first electrolytic cell after at least some heavy metal cations have passed through the first separator of the first electrolytic cell from the first anolyte compartment to the first catholyte compartment, and feeding said portion of the anolyte from the first anolyte compartment into the second anolyte compartment of the second electrolytic cell. It will be appreciated by those of skill in the art, that the step 855 of introducing anolyte from the first electrolytic cell into the second anolyte compartment of the second electrolytic cell includes feeding the anolyte into the second anolyte compartment of multiple second electrolytic cells such that the remaining steps may be done in parallel.

Thus the anolyte of the second anolyte compartment in the 2-cell system, will have a lower concentration of heavy metal than the anolyte of the first anolyte compartment in the 2-cell system.

The method 800 includes introducing 856 a catholyte into a second catholyte compartment of the second electrolytic cell. In one embodiment, the catholyte includes an alkali ion-conductive liquid. It will be appreciated by those of skill in the art that the steps of providing the first electrolytic cell, providing the second electrolytic cell, introducing 815 catholyte into the first catholyte compartment, and introducing 810 anolyte into the first anolyte compartment may be accomplished simultaneously. The catholyte introduced 850 into the second catholyte compartment of the second electrolytic cell may include an alkali ion-conductive liquid. In one embodiment, the alkali ion-conductive liquid is a molten alkali metal. In another embodiment, the alkali ion-conductive liquid is a solvent containing alkali metal ions.

In one embodiment, at least one of the first anolyte, the first catholyte, the second anolyte, and the second catholyte compartment is heated 858. It will be appreciated by those of skill in the art that the heat facilitates the dissolving of anolyte and catholyte in the system, creating an increase of ions and increasing cell performance.

The method includes the step of applying 860 a voltage to the second electrolytic cell. The voltage may be greater than the open circuit potential of the second electrolytic cell. With this voltage applied 860, metal cations in the anolyte of the first anolyte compartment move 862 through the second separator of the second electrolytic cell into the second catholyte compartment. In this embodiment of the 2-electrolytic cell system, because the second electrolytic cell includes an alkali ion-selective membrane as a second separator, the only metal cations that move 862 through the second separator membrane are alkali metal cations. The alkali metal cations are attracted to the charged second cathode and reduced 864 in the second catholyte compartment to form alkali metal.

With the application of voltage greater than the open circuit potential of the second electrolytic cell, the oxidation state of at least one sulfide ion in the anolyte of the second anolyte compartment is increased 865.

In one embodiment of the 2-electrolytic cell configuration, the step of applying 860 a voltage to the second electrolytic cell includes maintaining a ratio of sodium to Sulfur in the second anolyte compartment of the second electrolytic cell, such that the open circuit potential of the second electrolytic cell is less than or equal to 2.2V. In this embodiment, when the alkali metal being recovered is sodium, the sodium ions reduce to sodium metal, but the sulfide ions in the second anolyte compartment do not oxidize all the way to elemental sulfur. Instead, the sulfide ions increase and become higher. By way of non-limiting example, $S^{2-}$ may increase to the polysulfide $S_2^{2-}$, or the polysulfide $S_4^{2-}$ may increase to a higher polysulfide such as $S_6^{2-}$ or $S_8^{2-}$.

In one embodiment of the 2-electrolytic cell configuration, the step of applying 860 a voltage to the second electrolytic cell includes maintaining a ratio of lithium to Sulfur in the second anolyte compartment of the second electrolytic cell, such that the open circuit potential of the second electrolytic cell is less than or equal to 2.53V. In this embodiment, when the alkali metal being recovered is lithium, the lithium ions reduce to lithium metal, but the sulfide ions in the second anolyte compartment do not oxidize all the way to elemental sulfur. Instead, the sulfide ions increase and become higher. By way of non-limiting example, $S^{2-}$ may increase to the polysulfide $S_2^{2-}$, or the polysulfide $S_4^{2-}$ may increase to a higher polysulfide such as $S_6^{2-}$ or $S_8^{2-}$.

In another embodiment of the 2-electrolytic cell configuration, the step of applying 860 a voltage to the second electrolytic cell includes maintaining a ratio of sodium to Sulfur in the second anolyte compartment of the second electrolytic cell, such that the open circuit potential of the second electrolytic cell is greater than or equal to 2.3V. In this embodiment, when the alkali metal being recovered is sodium, the sodium ions reduce to sodium metal, and the sulfide ions in the second anolyte compartment oxidize all the way to elemental sulfur.

In one embodiment of the 2-electrolytic cell configuration, the step of applying 860 a voltage to the second electrolytic cell includes maintaining a ratio of lithium to Sulfur in the second anolyte compartment of the second electrolytic cell, such that the open circuit potential of the second electrolytic cell is greater than or equal to 2.63V. In this embodiment, when the alkali metal being recovered is lithium, the lithium ions reduce to lithium metal, and the sulfide ions in the second anolyte compartment oxidize all the way to elemental sulfur.

The method 800 further includes the step of removing 868 alkali metal from the second catholyte compartment and elemental Sulfur from the second anolyte compartment. This may be accomplished by any number of methods including without limitation those described in conjunction with FIGS. 1 and 2 above. The method 800 further comprising the step of removing 870 at least a portion of anolyte from the second anolyte compartment, after the step of removing 868 alkali metal from the second catholyte compartment and elemental Sulfur from the second anolyte compartment and the oxidation state of sulfide ions has been increased. In one embodiment the step of removing 870 a portion includes feeding that portion back into the second anolyte compartment. In this way the anolyte is recycled and more of the anolyte is in contact with the alkali ion-selective membrane and under the influence of the second cathode to help the transfer of alkali metal cations through the membrane for reduction in the second catholyte compartment. In one embodiment, the removing 870 step includes feeding a portion of the anolyte into the second anolyte compartment of one or more additional second electrolytic cells (not shown). In this embodiment, the process may run using the second electrolytic cell in series or in parallel. The step of removing 870 a portion of the anolyte in one embodiment also includes introducing the portion back into the first anolyte compartment. Using this embodiment of step 870 allows the system to operate in continuous mode, where the prior steps of method 800 may be repeated.

In one embodiment, the method 800 further includes the step of providing 875 a third electrolytic cell in fluid communication with the second electrolytic cell. In one embodiment, the third electrolytic cell is the third electrolytic cell described in conjunction with FIG. 5 above. The third electrolytic cell may include a third anolyte compartment configured to hold an anolyte. The third electrolytic cell may have a third anode positioned within the third anolyte compartment in communication with the anolyte. The third electrolytic cell may include a third catholyte compartment configured to hold a catholyte. The third electrolytic cell may include a third cathode positioned within the third catholyte compartment in communication with the catholyte. A third separator of the third electrolytic cell may be positioned between the third anolyte compartment and the third catholyte compartment and be in communication with the anolyte of the third compartment and the catholyte of the third compartment. The third separator in the third electrolytic cell may be an alkali-ion selective membrane configured to selectively transport alkali ions. The third electrolytic cell may also include a third power source in electrical communication with the third anode and the third cathode.

The method 800 includes the step of introducing 878 an anolyte into the third anolyte compartment of the third electrolytic cell. The anolyte may include at least one of an alkali metal sulfide and an alkali metal polysulfide, a polar organic solvent that dissolves at least one of the alkali metal sulfide, alkali metal polysulfide, and that dissolves elemental sulfur. In one embodiment, the step of introducing 878 anolyte into the third anolyte compartment of the third electrolytic cell includes removing at least a portion of the anolyte from the second anolyte compartment of the second electrolytic cell after at least some alkali metal cations have passed through the second separator of the second electrolytic cell from the second anolyte compartment to the second catholyte compartment, and feeding said portion of the anolyte from the second anolyte compartment into the third anolyte compartment of the third electrolytic cell.

In the embodiment with the third electrolytic cell, the method 800 includes introducing 880 a catholyte into the third catholyte compartment of the third electrolytic cell. The catholyte comprises an alkali ion-conductive liquid. In one embodiment, the alkali ion-conductive liquid is a molten alkali metal. In another embodiment, the alkali ion-conductive liquid is a solvent containing alkali metal ions. In one embodiment, at least one of the third anolyte compartment and the third catholyte compartment is heated 882. It will be appreciated that heat facilitates the dissolving of anolyte and catholyte in the system, creating an increase of ions and increasing cell performance. A voltage may then be applied 885 to the third electrolytic cell. The voltage may be applied by the third power source of the third electrolytic cell. In one embodiment of the 3-electrolytic cell configuration, the voltage applied 885 to the third electrolytic cell is sufficient oxidize at least one sulfide ion in the third electrolytic cell to form elemental Sulfur.

The method 800 includes the step of moving 888 alkali metal cations through the third separator of the third electrolytic cell from the third anolyte compartment to the third catholyte compartment. The alkali metal cations are attracted to the charged third cathode and are reduced 890 in the third catholyte compartment to form alkali metal.

With the application 885 of the predetermined voltage, at least one sulfide ion in the third anolyte compartment is oxidized 892 to form elemental Sulfur. In another embodiment of the 3-electrolytic cell configuration, the step of applying 885 a voltage to the third electrolytic cell to simultaneously cause the reduction of alkali metal ions into alkali metal and the oxidation of sulfide ions to elemental Sulfur, includes maintaining a ratio of sodium to Sulfur in the third anolyte compartment of the third electrolytic cell, such that the open circuit potential of the third electrolytic cell is greater than or equal to 2.3V. In this embodiment, when the alkali metal being recovered is sodium, the sodium ions reduce to sodium metal, and the sulfide ions in the third anolyte compartment oxidize all the way to elemental sulfur.

In one embodiment of the 3-electrolytic cell configuration, the step of applying 885 a voltage to the third electrolytic cell includes maintaining a ratio of lithium to Sulfur in the third anolyte compartment of the third electrolytic cell, such that the open circuit potential of the third electrolytic cell is greater than or equal to 2.63V. In this embodiment, when the alkali metal being recovered is lithium, the lithium ions reduce to lithium metal, and the sulfide ions in the third anolyte compartment oxidize all the way to elemental sulfur.

The method 800 further comprises the step of removing 894 elemental Sulfur from the third anolyte compartment and alkali metal from third catholyte compartment. This step may be accomplished using any of the separation processes described herein.

The method 800 further includes removing 898 a portion of the anolyte from the third anolyte compartment after alkali metal cations have moved into the third catholyte compartment to be reduced and the oxidation state of sulfide ions in the third catholyte compartment has been increased to elemental sulfur. In one embodiment the step of removing 898 a portion of the anolyte in the third anolyte compartment includes feeding that portion back into the third anolyte compartment. In this way the anolyte is recycled and more of the anolyte is in contact with the alkali ion-selective membrane of the third electrolytic cell and under the influence of the third cathode to help the transfer of alkali metal cations through the membrane for reduction in the third catholyte compartment. In one embodiment, the removing 898 step includes feeding a portion of the anolyte into the third anolyte compartment of one or more additional third electrolytic cells (not shown). In this embodiment, the process may run using the third electrolytic cell in series or in parallel. The step of removing 898 a portion of the anolyte from the third anolyte compartment in one embodiment also includes introducing the portion back into the first anolyte compartment. Using this embodiment of step 898 allows the system to operate in continuous mode, where all the prior steps of method 800 may be repeated.

The method 800 of recovering metal and elemental Sulfur may further be understood by reference to the system described herein in conjunction with FIG. 5 and any discussions of using the same are contemplated by the method of the present invention described in conjunction with FIG. 8.

While specific embodiments of the present invention have been illustrated and described, numerous modifications come to mind without significantly departing from the spirit of the invention, and the scope of protection is only limited by the scope of the accompanying claims.

The invention claimed is:

1. A system for recovering metal and elemental Sulfur from a non-aqueous feed stream, comprising:

a first electrolytic cell comprising:

a first anolyte compartment configured to hold an anolyte, wherein the anolyte comprises at least one of an alkali metal sulfide and an alkali metal poly sulfide, a polar organic solvent that dissolves elemental Sulfur and dissolves at least one of the alkali metal sulfide and the alkali metal polysulfide, the anolyte further comprising at least one of a heavy metal, a heavy metal compound, and a heavy metal ion;

a first anode positioned within the first anolyte compartment in communication with the anolyte;

a first catholyte compartment configured to hold a catholyte, wherein the catholyte comprises an alkali ion-conductive liquid;

a first cathode positioned within the first catholyte compartment in communication with the catholyte;

a first separator positioned between the first anolyte compartment and the first catholyte compartment, the first separator in communication with the anolyte of the first anolyte compartment and the catholyte of the first catholyte compartment, the first separator configured to non-selectively transport cations; and a first power source in electrical communication with the first anode and the first cathode, wherein the first power source is configured to apply a voltage to the first electrolytic cell that is sufficient to reduce at least one heavy metal ion to heavy metal; and further comprising a second electrolytic cell in fluid communication with the first electrolytic cell, wherein the second electrolytic cell comprises:

a second anolyte compartment configured to hold a anolyte, wherein the anolyte comprises at least one of an alkali metal sulfide and an alkali metal polysulfide, a polar organic solvent that dissolves elemental Sulfur and dissolves at least one of the alkali metal sulfide and the alkali metal poly sulfide, the anolyte of the second compartment further comprising at least a portion of anolyte removed from the first anolyte compartment of the first electrolytic cell;

a second anode positioned within the second anolyte compartment m communication with the anolyte;

a second catholyte compartment configured to hold a catholyte, wherein the catholyte comprises an alkali ion-conductive liquid;

a second cathode positioned within the second catholyte compartment m communication with the catholyte;

a second separator positioned between the second anolyte compartment and the second catholyte compartment, the second separator in communication with the anolyte of the second anolyte compartment and the catholyte of the second catholyte compartment, wherein the second separator is an alkali-ion selective membrane configured to selectively transport alkali ions; and a second power source in electrical communication with the second anode and the second cathode, wherein the second power source is configured to apply a voltage to the second electrolytic cell that is greater than the open circuit potential of the second electrolytic cell, wherein the second electrolytic cell is configured to separate and recover the alkali metal and elemental Sulfur.

2. The system of claim 1, wherein the anolyte of the first anolyte compartment further comprises elemental Sulfur.

3. The system of claim 1, wherein the first separator comprises at least one of a cation exchange membrane and a microporous membrane.

4. The system of claim 1, further comprising a first heater in operable communication with at least one of the first anolyte compartment and the first catholyte compartment, and wherein at least one of the first anolyte compartment and catholyte compartments is configured to operate at temperature of below the melting point of the alkali metal in the at least one of the alkali metal sulfide and alkali metal polysulfide.

5. The system of claim 1, further comprising a first heater in operable communication with at least one of the first anolyte compartment and the first catholyte compartment, and wherein at least one of the first anolyte compartment and catholyte compartments is configured to operate at temperature ranging from 100° C. to 160° C.

6. The system of claim 5, wherein the temperature ranges from 120° C. to 150° C.

7. The system of claim 1, wherein the ion-conductive liquid comprises at least one of a catholyte solvent containing alkali metal ions and molten alkali metal.

8. The system of claim 1, wherein the first anolyte compartment comprises a turbulence promotor.

9. The system of claim 1, wherein first anolyte compartment is configured to allow anolyte to flow through the first anolyte compartment in a continuous or semi-continuous manner.

10. The system of claim 1, further comprising a cooling apparatus in communication with the first anolyte compartment to facilitate the removal of elemental Sulfur from the anolyte compartment.

11. The system of claim 1, wherein the first power source is configured to apply a voltage to the first electrolytic cell sufficient to reduce at least one alkali metal ion in the first electrolytic cell to alkali metal.

12. The system of claim 1, wherein the first power source is configured to apply a voltage to the first electrolytic cell that is greater than the open circuit potential of the first electrolytic cell.

13. The system of claim 1, wherein the first power source is configured to apply a voltage to the first electrolytic cell sufficient to increase the oxidation state of at least one sulfide ion in the first electrolytic cell.

14. The system of claim 1, wherein the alkali metal comprises sodium and the ratio of sodium to Sulfur in the first anolyte compartment is such that the open circuit potential of the first electrolytic cell is greater than 2.3V.

15. The system of claim 1, wherein the alkali metal comprises lithium and the ratio of lithium to Sulfur in the first anolyte compartment is such that the open circuit potential of the first electrolytic cell is greater than 2.63V.

16. The system of claim 1, wherein the first power source is configured to apply a voltage to the first electrolytic cell that is less than 5V.

17. The system of claim 1, wherein the first power source is configured to apply a voltage to the first electrolytic cell that is at least 0.2V below the open cell potential of the first electrochemical cell.

18. The system of claim 1, wherein the first power source is configured to apply a voltage to the first electrolytic cell insufficient to reduce alkali metal ions in the first electrolytic cell to alkali metal.

19. The system of claim 1, wherein the first power source is configured to apply a voltage to the first electrolytic cell that ranges between about 0.7V and about 2.0V.

20. The system of claim 1, wherein the second power source is configured to apply a voltage to the second electrolytic cell that is sufficient to increase the oxidation state of at least one sulfide ion in the second electrolytic cell.

21. The system of claim 1, wherein the alkali metal in at least one of the alkali metal sulfide and alkali metal polysulfide in the second anolyte compartment comprises sodium, and wherein the ratio of sodium to Sulfur in the second anolyte compartment is such that the open circuit potential of the second electrolytic cell is greater than or equal to 2.3V.

22. The system of claim 1, wherein the alkali metal in at least one of the alkali metal sulfide and alkali metal polysulfide in the second anolyte compartment comprises lithium, and wherein the ratio of lithium to Sulfur in the second anolyte compartment is such that the open circuit potential of the second electrolytic cell is greater than 2.63V.

23. The system of claim 1, further comprising a third electrolytic cell in fluid communication with the second electrolytic cell, the third electrolytic cell comprising:

a third anolyte compartment configured to hold an anolyte, wherein the anolyte comprises at least one of an alkali metal sulfide and an alkali metal polysulfide, a polar organic solvent that dissolves elemental Sulfur and dissolves at least one of the alkali metal sulfide and the alkali metal polysulfide, the anolyte of the third anolyte compartment further comprising at least a portion of anolyte removed from the second anolyte compartment of the second electrolytic cell;

a third anode positioned within the third anolyte compartment in communication with the anolyte;

a third catholyte compartment configured to hold a catholyte, wherein the catholyte comprises an alkali ion-conductive liquid;

a third cathode positioned within the third catholyte compartment m communication with the catholyte;

a third separator positioned between the third anolyte compartment and the third catholyte compartment, the third separator in communication with the anolyte of the third anolyte compartment and the catholyte of the third catholyte compartment, wherein the third separator is an alkali-ion selective membrane configured to selectively transport alkali ions; and a third power source in electrical communication with the third anode and the third cathode, wherein the third power source is configured to apply a voltage to the third electrolytic cell that is sufficient to oxidize sulfide ions to form elemental Sulfur.

24. The system of claim 18, wherein the alkali metal in at least one of the alkali metal sulfide and alkali metal poly sulfide in the second anolyte compartment comprises sodium, and the ratio of sodium to Sulfur in the second anolyte compartment of the second electrolytic cell is such that the open circuit potential of the second electrolytic cell is less than or equal to 2.2V.

25. The system of claim 18, wherein the alkali metal in at least one of the alkali metal sulfide and alkali metal polysulfide in the second anolyte compartment comprises lithium and the ratio of lithium to Sulfur in the second anolyte compartment of the second electrolytic cell is such that the open circuit potential of the second electrolytic cell is less than or equal to 2.53V.

26. The system of claim 18, wherein the alkali metal in at least one of the alkali metal sulfide and alkali metal polysulfide in the third anolyte compartment comprises sodium and the ratio of sodium to Sulfur in the third anolyte compartment is such that the open circuit potential of the third electrolytic cell is greater than or equal to 2.3V.

27. The system of claim 18, wherein the alkali metal in at least one of the alkali metal sulfide and alkali metal polysulfide in the third anolyte compartment comprises lithium and the ratio of lithium to Sulfur in the third anolyte compartment is such that the open circuit potential of the third electrolytic cell is greater than or equal to 2.63V.

28. A method for recovering metal and Sulfur from a feed stream, comprising:

a first anolyte compartment configured to hold an anolyte;

a first anode positioned within the first anolyte compartment in communication with the anolyte;

a first catholyte compartment configured to hold a catholyte, wherein the catholyte comprises an alkali ion-conductive liquid;

a first cathode positioned within the first catholyte compartment m communication with the catholyte;

a first separator positioned between the first anolyte compartment and the first catholyte compartment, the first separator in communication with the anolyte of the first compartment and the catholyte of the first compartment, the first separator configured to non-selectively transport cations; and a first power source in electrical communication with the first anode and the first cathode;

introducing an anolyte into the first anolyte compartment of the first electrolytic cell, wherein the anolyte comprises at least one of an alkali metal sulfide and an alkali metal polysulfide, a polar organic solvent that dissolves at least one of the alkali metal sulfide, alkali metal polysulfide, and that dissolves elemental sulfur, the anolyte further comprising at least one of a heavy metal, a heavy metal compound, and a heavy metal ion;

introducing a catholyte into the first catholyte compartment of the first electrolytic cell, wherein the catholyte comprises an alkali ion-conductive liquid;

applying a voltage to the first electrolytic cell that is sufficient to reduce at least one heavy metal ion to heavy metal;

oxidizing at least one sulfide ion in the anolyte of the first anolyte compartment of the first electrolytic cell;

moving cations to pass through the first separator positioned between, and in communication with the first anolyte compartment and the first catholyte compartment, the cations passing from the first anolyte compartment to the first catholyte compartment; and reducing at least one of said cations in the catholyte compartment to form metal.

29. The method of claim 28, wherein introducing an anolyte into the first anolyte compartment of the first electrolytic cell comprises introducing elemental Sulfur into the first anolyte compartment of the first electrolytic cell.

30. The method of claim 28, wherein introducing an anolyte into the first anolyte compartment of the first electrolytic cell comprises dissolving at least one of an alkali metal sulfide and an alkali metal polysulfide in a polar organic solvent.

31. The method of claim 28, wherein applying a voltage to the first electrolytic cell comprises applying a voltage that is sufficient to reduce alkali metal ions in the first electrolytic cell to alkali metal.

32. The method of claim 28, wherein applying a voltage to the first electrolytic cell comprises applying a voltage that is sufficient to increase the oxidation state of at least one sulfide ion in the first electrolytic cell such that elemental Sulfur is formed.

33. The method of claim 28, further comprising heating at least one of the first anolyte compartment and the first catholyte compartment.

34. The method of claim 28, further comprising removing metal from the first catholyte compartment and elemental Sulfur from the first anolyte compartment.

35. The method of claim 28, further comprising:

providing a second electrolytic cell in fluid communication with the first electrolytic cell, the second electrolytic cell comprising:

a second anolyte compartment configured to hold a anolyte;

a second anode positioned within the second anolyte compartment in communication with the anolyte;

a second catholyte compartment configured to hold a catholyte;

a second cathode positioned within the second catholyte compartment in communication with the catholyte;

a second separator positioned between the second anolyte compartment and the second catholyte compartment, the second separator in communication with the anolyte of the second anolyte compartment and the catholyte of the second catholyte compartment, wherein the second separator is an alkali-ion selective membrane configured to selectively transport alkali ions; and a second power source in electrical communication with the second anode and the second cathode;

introducing an anolyte into the second anolyte compartment of the second electrolytic cell, wherein the anolyte comprises at least one of an alkali metal sulfide and an alkali metal poly sulfide, a polar organic solvent that dissolves at least one of the alkali metal sulfide, alkali metal polysulfide, and that dissolves elemental sulfur, and wherein introducing an anolyte into the second anolyte compartment of the second electrolytic cell comprises introducing at least a portion of anolyte removed from the first anolyte compartment of the first electrolytic cell into the second anolyte compartment of the second electrolytic cell;

introducing a catholyte into the second catholyte compartment of the second electrolytic cell, wherein the catholyte comprises an alkali ion-conductive liquid;

applying a voltage to the second electrolytic cell that is greater than the open circuit potential of the second electrolytic cell;

causing alkali metal cations to pass through the second separator of the second electrolytic cell from the second anolyte compartment to the second catholyte compartment;

reducing at least one metal cation in the second catholyte compartment to form an alkali metal;

increasing the oxidation state of at least one sulfide 10n m the second anolyte compartment of the second electrolytic cell.

36. The method of claim 35 further comprising, removing a portion of the anolyte from the second anolyte compartment after the applying a voltage step and introducing the portion into at least one of first anolyte compartment and the second anolyte compartment.

37. The method of claim 35, wherein the first power source is configured to apply a voltage to the first electrolytic cell that is insufficient to reduce alkali metal ions in the first electrolytic cell to alkali metal.

38. The method of claim 35, wherein the alkali metal in at least one of the alkali metal sulfide and alkali metal poly sulfide in the second anolyte compartment comprises sodium, and the ratio of sodium to Sulfur in the second anolyte compartment is such that the open circuit potential of the second electrolytic cell is greater than or equal to 2.3V.

39. The method of claim 35, wherein the alkali metal in at least one of the alkali metal sulfide and alkali metal poly sulfide in the second anolyte compartment comprises lithium, and the ratio of lithium to Sulfur in the second anolyte compartment is such that the open circuit potential of the second electrolytic cell is greater than or equal to 2.63V.

40. The method of claim 35, further comprising removing alkali metal from the second catholyte compartment and elemental Sulfur from the second anolyte compartment.

41. The method of claim 40, further comprising removing at least a portion of anolyte from the second anolyte compartment, after the step of removing alkali metal from the second catholyte compartment and elemental Sulfur from the second anolyte compartment, and feeding said portion of the anolyte into at least one of the first anolyte compartment and the second anolyte compartment.

42. The method of claim 35, further comprising:

providing a third electrolytic cell, comprising:

a third anolyte compartment configured to hold a anolyte;

a third anode positioned within the third anolyte compartment in communication with the anolyte;

a third catholyte compartment configured to hold a catholyte;

a third cathode positioned within the third catholyte compartment m communication with the catholyte;

a third separator positioned between the third anolyte compartment and the third catholyte compartment, the third separator in communication with the anolyte of the third anolyte compartment and the catholyte of the third catholyte compartment, wherein the third separator is an alkali-ion selective membrane configured to selectively transport alkali ions; and a third power source in electrical communication with the third anode and the third cathode;

introducing an anolyte into the third anolyte compartment of the third electrolytic cell, wherein the anolyte comprises at least one of an alkali metal sulfide and an alkali metal polysulfide, a polar organic solvent that dissolves at least one of the alkali metal sulfide, alkali metal polysulfide, and that dissolves elemental sulfur, and wherein introducing an anolyte into the third anolyte compartment of the third electrolytic cell comprises introducing at least a portion of anolyte removed from the second anolyte compartment of the second electrolytic cell into the third anolyte compartment of the third electrolytic cell;

introducing a catholyte into the third catholyte compartment of the third electrolytic cell, wherein the catholyte comprises an alkali ion-conductive liquid;

applying a voltage to the third electrolytic cell sufficient to increase the oxidation state of at least one sulfide ion in the third electrolytic cell to form elemental Sulfur;

causing alkali metal cations to pass through the third separator of the third electrolytic cell from the third anolyte compartment to the third catholyte compartment;

reducing at least one alkali metal cation in the third catholyte compartment to form an alkali metal; and oxidizing at least one sulfide ion in the third anolyte compartment to form elemental sulfur.

43. The method of claim 42, wherein the alkali metal in at least one of the alkali metal sulfide and alkali metal polysulfide in the second anolyte compartment comprises sodium, and the ratio of sodium to Sulfur in the second anolyte compartment of the second electrolytic cell is such that the open circuit potential of the second electrolytic cell is less than or equal to 2.2V.

44. The method of claim 42, wherein the alkali metal in at least one of the alkali metal sulfide and alkali metal polysulfide in the second anolyte compartment comprises lithium and the ratio of lithium to Sulfur in the second anolyte compartment of the second electrolytic cell is such that the open circuit potential of the second electrolytic cell is less than or equal to 2.53V.

45. The method of claim 42, further comprising removing alkali metal from the third catholyte compartment and elemental Sulfur from the third anolyte compartment.

46. The method of claim 45, further comprising removing at least a portion of anolyte from the third anolyte compartment, after the step of removing alkali metal from the third catholyte compartment and elemental Sulfur from the third anolyte compartment, and feeding said portion of the anolyte into at least one of the first anolyte compartment and the third anolyte compartment.

* * * * *